US006278344B1

(12) United States Patent
Kurisu et al.

(10) Patent No.: US 6,278,344 B1
(45) **Date of Patent: *Aug. 21, 2001**

(54) MULTIPLE-MODE DIELECTRIC RESONATOR AND METHOD OF ADJUSTING CHARACTERISTIC OF THE RESONATOR

(75) Inventors: Toru Kurisu, Omihachiman; Shin Abe, Muko, both of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/550,727

(22) Filed: Apr. 17, 2000

Related U.S. Application Data

(62) Division of application No. 09/017,954, filed on Feb. 3, 1998, now Pat. No. 6,072,378.

(30) Foreign Application Priority Data

Feb. 3, 1997 (JP) ..... 9-20600
Oct. 21, 1997 (JP) ..... 9-288378
Jan. 7, 1998 (JP) ..... 10-1416

(51) Int. Cl.[7] ..... H01P 7/10; H01P 1/20
(52) U.S. Cl. ..... 333/219.1; 333/202; 333/235
(58) Field of Search ..... 333/202, 219.1, 333/227, 235

(56) References Cited

U.S. PATENT DOCUMENTS 4,623,857 * 11/1986 Nishikawa et al. ..... 333/219
5,710,530 * 1/1998 Wada et al. ..... 333/219.1
5,796,320 * 8/1998 Hattori et al. ..... 333/219.1
6,072,378 * 6/2000 Kurisu et al. ..... 333/219.1

FOREIGN PATENT DOCUMENTS 661770A 7/1995 (EP) .
04296104A 10/1992 (JP) .
7-283601 * 10/1995 (JP) .
08167802A 6/1996 (JP) .
8-288717 * 11/1996 (JP) .
10-224113 * 8/1998 (JP) .

OTHER PUBLICATIONS

European Search Report, Sep. 14, 2000.

* cited by examiner

*Primary Examiner*—Robert Pascal
*Assistant Examiner*—Barbara Summons
(74) *Attorney, Agent, or Firm*—Ostrolenk, Faber, Gerb & Soffen, LLP

(57) ABSTRACT

A multiple-mode dielectric resonator in which a combined dielectric block formed of a plurality of dielectric elements combined into a crossed shape is used to cause three resonance modes along a plane defined by two of the dielectric elements, and in which the resonant frequency of each mode is determined, or a multiple-mode dielectric resonator in which the degree of coupling between predetermined resonance modes is determined. If first and third resonance modes are two TM110 modes having different lines of symmetry of electric field distributions, and if a second mode is a TM111 mode, dielectric-cut portions are formed in the combined dielectric block, for example, at positions where the electric field distribution of the first resonance mode is concentrated while the electric field distributions of the second and third resonance modes are not concentrated, thereby selectively determining the resonant frequency of the first resonance mode.

2 Claims, 23 Drawing Sheets

FIRST RESONANCE MODE

SECOND RESONANCE MODE

THIRD RESONANCE MODE (RESONANT FREQUENCY ADJUSTMENT)

FIRST RESONANCE MODE
(RESONANT FREQUENCY ADJUSTMENT)

SECOND RESONANCE MODE

THIRD RESONANCE MODE

FIRST RESONANCE MODE
(RESONANT FREQUENCY ADJUSTMENT)

SECOND RESONANCE MODE

THIRD RESONANCE MODE

FIRST RESONANCE MODE

SECOND RESONANCE MODE

THIRD RESONANCE MODE
(RESONANT FREQUENCY ADJUSTMENT)

FIRST RESONANCE MODE

SECOND RESONANCE MODE
(RESONANT FREQUENCY ADJUSTMENT)

THIRD RESONANCE MODE

FIRST RESONANCE MODE
(COUPLING ADJUSTMENT)

SECOND RESONANCE MODE
(COUPLING ADJUSTMENT)

THIRD RESONANCE MODE

FIRST RESONANCE MODE

SECOND RESONANCE MODE
(COUPLING ADJUSTMENT)

THIRD RESONANCE MODE
(COUPLING ADJUSTMENT)

FIRST RESONANCE MODE
(COUPLING ADJUSTMENT)

SECOND RESONANCE MODE

THIRD RESONANCE MODE $TM^{Y}110$ MODE $TM^{X}110$ MODE

FIRST RESONANCE MODE
(COUPLING ADJUSTMENT)

SECOND RESONANCE MODE
(COUPLING ADJUSTMENT)

THIRD RESONANCE MODE
(COUPLING ADJUSTMENT)

MULTIPLE-MODE DIELECTRIC RESONATOR AND METHOD OF ADJUSTING CHARACTERISTIC OF THE RESONATOR

This is a division of application Ser. No. 09/017,954, now U.S. Pat. No. 6,072,378 filed Feb. 3, 1998.

BACKGROUND OF THE INVENTION

1. Field of the Invention

The present invention relates to a multiple-mode dielectric resonator having a combined dielectric block provided in a cavity, and to a method of adjusting a characteristic of the resonator.

2. Description of the Related Art

FIG. 23 shows the structure of a conventional dielectric resonator using a transverse magnetic (TM) dual mode. In other figures referred to below, a finely dotted area represents a portion on which a conductor is formed.

This dielectric resonator has, as shown in FIG. 23, a cavity body 1 which functions as a waveguide, and a combined dielectric block 2 which is formed of two dielectric elements 2*a* and 2*b* combined into a crossed shape, and which is formed integrally with the cavity body 1 and while being positioned inside with the same. The cavity body 1 and the combined dielectric block 2 are made of a dielectric ceramic. A conductor 3 such as Ag is formed on outer peripheral surfaces of the cavity body 1. Conductor plates (not shown) or portions of a metallic case for accommodating this dielectric resonator are attached to two opening end surfaces around two openings of the cavity body 1.

The dielectric resonator shown in FIG. 23, having two dielectric elements 2*a* and 2*b* each resonating in a TM110 mode, functions as a TM dual mode dielectric resonator. One unit of the above-described conventional TM dual mode dielectric resonator, however, can only be used as two independent resonators or as two-stage resonator having two resonators coupled to each other. As three resonators forming one dielectric resonator unit, a TM triple mode dielectric resonator designed to cause three TM110 resonance modes by forming a combined dielectric block having three dielectric elements perpendicular to each other has been proposed. Such a conventional TM triple mode dielectric resonator, however, has a complicated overall structure and requires a high manufacturing cost if an ordinary manufacturing method is used.

The applicant of the present invention has filed the Japanese Patent Application No. 21394/1996 proposing a dielectric resonator which has a combined dielectric block formed of two dielectric elements combined into a crossed shape, and which is designed to use three resonance modes.

On the other hand, in a case where a band-pass filter, for example, is formed of a TM dual mode dielectric resonator, such as that shown in FIG. 23, using two TM111 modes, resonance in a TM111 mode can occur in an attenuation range of the band-pass filter when a particular combination of an external size of the cavity body and a cross-sectional configuration of the dielectric block is used. Because of this phenomenon, it has been difficult to obtain a desirable attenuation characteristic.

SUMMARY OF THE INVENTION

In view of these circumstances, an object of the present invention is to provide a multiple-mode dielectric resonator in which each of the resonant frequencies of the three resonance modes used in the dielectric resonator of the above-mentioned preceding application or a larger number of resonance modes is determined, or a multiple-mode dielectric resonator in which the degree of coupling between predetermined resonance modes is determined.

Another object of the present invention is to provide a dielectric resonator designed to easily obtain a dielectric filter having a desired characteristic by setting the resonant frequency of a TM111 mode and the resonant frequencies of TM110 modes relative to each other, and to provide a method of adjusting a characteristic of the resonator in such a manner.

According to a first aspect of the present invention, in a multiple-mode dielectric resonator having a region surrounded with a conductor, and a combined dielectric block formed of a plurality of dielectric elements combined into a crossed shape, the combined dielectric block being placed in the region surrounded with the conductor, the resonant frequency of a predetermined one of three resonance modes along a plane defined by two of the plurality of dielectric elements is determined in such a manner that one of first to third resonance modes having a higher degree of concentration of an electric field distribution in at least one region in comparison with the other two of the first to third resonance modes is set as a resonant frequency setting object, the first and third resonance modes comprising two pseudo TM110 modes having different lines of symmetry of electric field distributions, the second resonance mode comprising a pseudo TM111 mode, and a dielectric-cut portion is formed in a portion of the combined dielectric block corresponding to the region with the higher degree of concentration of the electric field distribution, or a dielectric material is applied to a portion of the combined dielectric block corresponding to the same region.

The resonant frequency of one of the resonance modes set as a resonant frequency setting object can be changed relatively largely in comparison with the resonant frequencies of the other two resonance modes, and can therefore be determined independently of the resonant frequencies of the other two resonance modes.

According to a second aspect of the present invention, one of first to third resonance modes having no concentration or a lower degree of concentration of an electric field distribution in at least one region in comparison with the other two of the first to third resonance modes is set as a resonant frequency setting object, the first and third resonance modes comprising two pseudo TM110 modes having different lines of symmetry of electric field distributions, the second resonance mode comprising a pseudo TM111 mode. A dielectric-cut portion is formed in a portion of the combined dielectric block corresponding to the region with no concentration or a lower degree of concentration of the electric field distribution, or a dielectric material is applied to a portion of the combined dielectric block corresponding to this region. Both the resonant frequencies of the two resonance modes other than the resonant frequency setting object can be thereby changed, thereby enabling the resonant frequency of the one resonance mode set as the resonant frequency setting object to be determined relative to the resonant frequencies of the other two resonance modes.

According to a third aspect of the present invention, the degree of coupling between two of the three resonance modes is determined in such a manner that a dielectric-cut portion is formed in at least one predetermined portion of the combined dielectric block, or a dielectric material is applied to at least one predetermined portion of the combined dielectric block, thereby reducing the degree of symmetry of the combined dielectric block about a diagonal line parallel to an electric field of the first resonance mode. If the degree of this symmetry is reduced, coupling occurs between the first and second resonance modes. The degree of the coupling is determined by the amount of cut in the predetermined portion or the amount of the dielectric material applied to the predetermined portion.

According to a fourth aspect of the present invention, assuming two pseudo TM110 modes having different lines of symmetry of electric field distributions as first and third modes and assuming a pseudo TM111 mode as a second resonance mode, a dielectric-cut portion is formed in at least one predetermined portion of the combined dielectric block, or a dielectric material is applied to at least one predetermined portion of the combined dielectric block, thereby causing a difference in shape between two of the plurality of dielectric elements defining one plane, which difference relates to a resonant frequency characteristic. The first resonance mode and the third resonance modes are thereby coupled to each other. The degree of this coupling is determined by the amount of cut in the predetermined portion or the amount of the dielectric material applied to the predetermined portion.

According to a fifth aspect of the present invention, with respect to two pseudo TM110 modes having different lines of symmetry of electric field distributions and a pseudo TM111 mode, a dielectric-cut portion is formed in the combined dielectric block in at least one region where there is a difference in electric field distribution intensity between the pseudo TM110 modes and the pseudo TM111 mode, or a dielectric material is applied to a portion of the combined dielectric block in same region, thereby determining the resonant frequencies of the pseudo TM110 modes and the pseudo TM111 mode relative to each other. In this manner, in forming a dielectric filter using the TM110 modes, the resonant frequency of the TM111 mode used as a spurious mode can be determined relative to the resonant frequencies of the TM110 modes without changing the resonant frequencies of the TM110 modes.

According to a sixth aspect of the present invention, with respect to two pseudo TM110 modes having different lines of symmetry of electric field distributions and a pseudo TM111 mode, a dielectric-cut portion is formed in the combined dielectric block in at least one region where the electric field distribution intensity of the pseudo TM110 modes is higher than the electric field distribution intensity of the pseudo TM111 mode, thereby bringing the resonant frequencies of the pseudo TM110 modes closer to the resonant frequency of the pseudo TM111 mode to cause coupling between the pseudo TM110 modes and the pseudo TM110 mode. In this manner, a dielectric resonator device formed of a plurality of dielectric resonator stages can be formed.

According to a seventh aspect of the present invention, with respect to two pseudo TM110 modes having different lines of symmetry of electric field distributions and a pseudo TM111 mode, a dielectric material is applied to a portion of the combined dielectric block in at least one region where the electric field distribution intensity of the pseudo TM111 mode is higher than the electric field distribution intensity of the pseudo TM110 modes, thereby bringing the resonant frequency of the pseudo TM111 mode closer to the resonant frequencies of the pseudo TM110 modes to cause coupling between the pseudo TM110 modes and the pseudo TM111 mode. In this manner, a dielectric resonator device formed of a plurality of dielectric resonator stages can be formed.

According to an eighth aspect of the present invention, one of the above-described multiple-mode dielectric resonators is provided with input and output coupling means capable of coupling to predetermined resonance modes in the resonance modes of the multiple-mode dielectric resonator. In this manner, the multiple-mode dielectric resonator is designed to be used a dielectric filter having a plurality of resonator stages.

According to a ninth aspect of the present invention, a plurality of multiple-mode dielectric resonators corresponding to that according to the eighth aspect of the invention are provided with at least three sections each used as one of an input section and an output section, thereby forming an input and output device sharing an input or output section for a duplexer, a multiplexer or the like.

DESCRIPTION OF THE PREFERRED EMBODIMENTS

Figure 1:
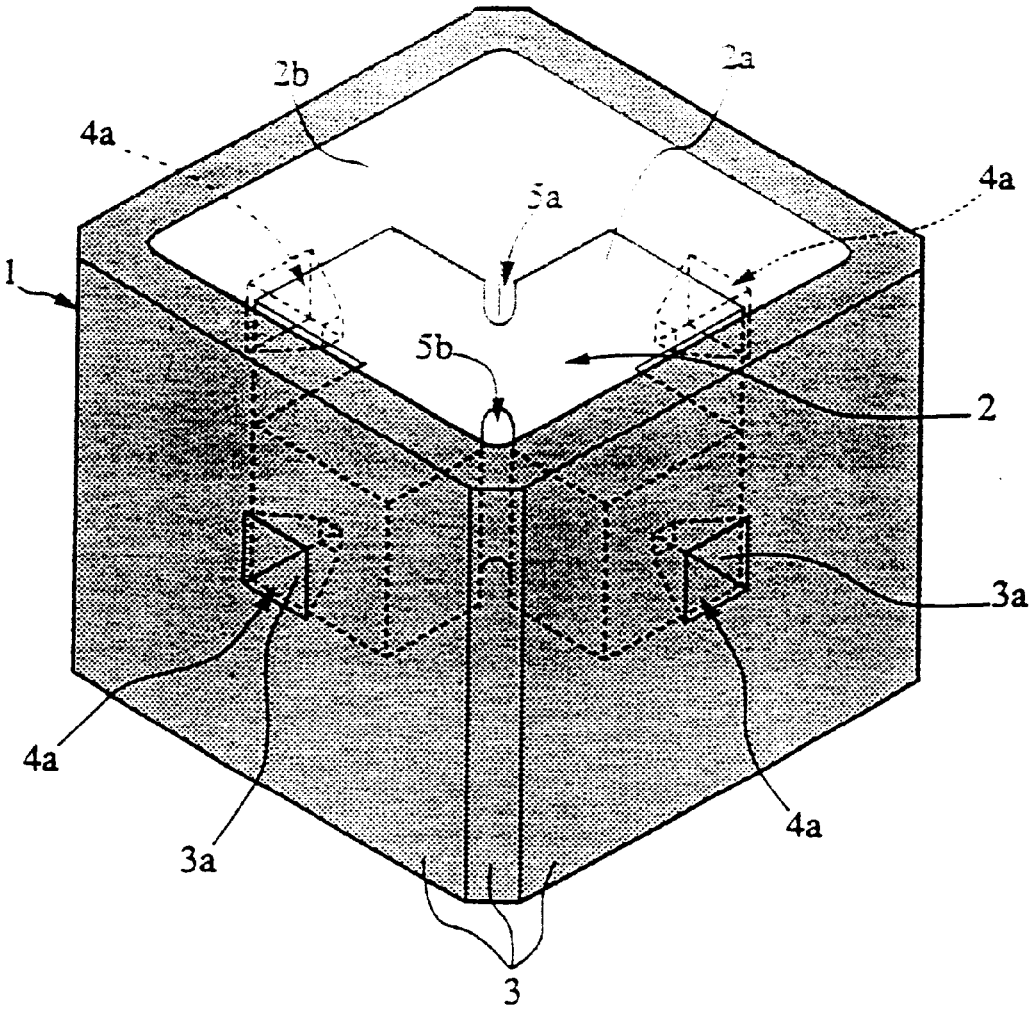
FIG. 1 is a perspective view of a multiple-mode dielectric resonator which represents a first embodiment of the present invention.

The structure of a multiple-mode dielectric resonator which represents a first embodiment of the present invention will be described below with reference to FIGS. 1 and 2.

In the figures referred to below, portions identical, corresponding, or equivalent in function to those of the above-described conventional dielectric resonator are indicated by the same reference numerals. As shown in FIG. 1, which is a perspective view of the multiple-mode dielectric resonator, a combined dielectric block 2 formed of two dielectric elements 2*a* and 2*b* combined into a crossed shape is formed integrally with a cavity body 1 while being positioned inside the same. At a center of each of end surfaces of the dielectric elements 2*a* and 2*b* connected to the cavity body 1, a hole 4*a* is formed in the outer surface of the cavity body 1 so as extend to an inner portion of the dielectric elements 2*a* or 2*b*, and a conductor 3*a* is formed on inner surfaces of each hole 4*a*. This conductor 3*a* connects to a conductor 3 formed on peripheral surfaces of the cavity body 1. Two diagonal corner portions in four crossing corner portions of the combined dielectric block 2 are cut to form dielectric-cut portions 5*a* and 5*b* (portions such as dielectric-cut portions 5*a* and 5*b* in the crossing portions hereinafter referred to as "crisscross corner grooves"). The resonant frequency of a first resonance mode is thereby determined, as described below.

Figure 2A:
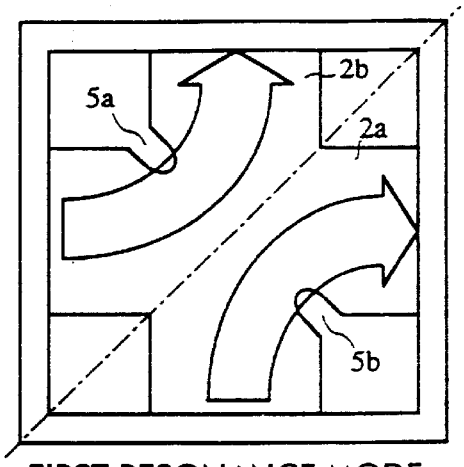
FIGS. 2A, 2B, and 2C are plan views of electric field distributions of three resonance modes in the dielectric resonator shown in FIG. 1.
Figure 2B:
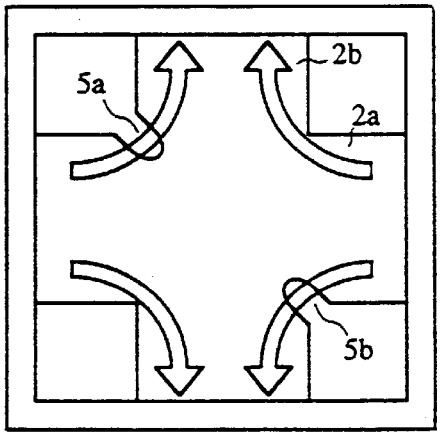
Figure 2C:
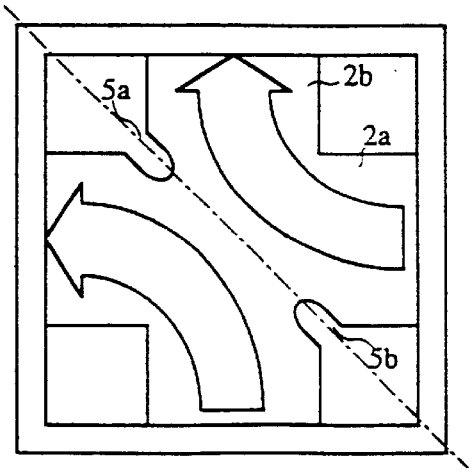

FIGS. 2A, 2B, and 2C are plan views of the multiple-mode dielectric resonator shown in FIG. 1, schematically showing electric field distributions of first, second, and third resonance modes, respectively. The first and third resonance modes are pseudo TM110 modes while the second resonance mode is a pseudo TM111 mode. As shown in FIGS. 2A to 2C, crisscross corner grooves 5*a* and 5*b* are formed in places where the electric field distribution of the first resonance mode is concentrated while the electric field distributions of the second and third resonance modes is not substantially concentrated. More specifically, crisscross corner grooves 5*a* and 5*b* are formed in positions such as to be symmetrical about a diagonal line parallel to the electric field distribution of the first resonance mode (at positions on a diagonal line parallel to the electric field in the third resonance mode), and in two diagonal corner portions in four crossing corner portions of the combined dielectric block 2. The resonant frequency of the first resonance mode is changed largely relative to the resonant frequencies of the other two resonance modes by selecting the depth of the crisscross corner grooves 5*a* and 5*b* in the direction perpendicular to the plane of FIGS. 2A to 2C or the depth of these grooves in the direction parallel to the plane of the figures, thereby determining the resonant frequency of the first resonance mode substantially independently.

The above-described crisscross corner grooves 5*a* and 5*b* may be formed simultaneously with integral formation of the cavity body 1 and the combined dielectric block 2 to adjust the resonant frequency of the first resonance mode to a value previously set at a design stage. Alternatively, the crisscross corner grooves 5*a* and 5*b* may be formed after integral formation of the cavity body 1 and the combined dielectric block 2 by cutting with a router or the like to adjust the resonant frequency to a target value.

Figure 3A:
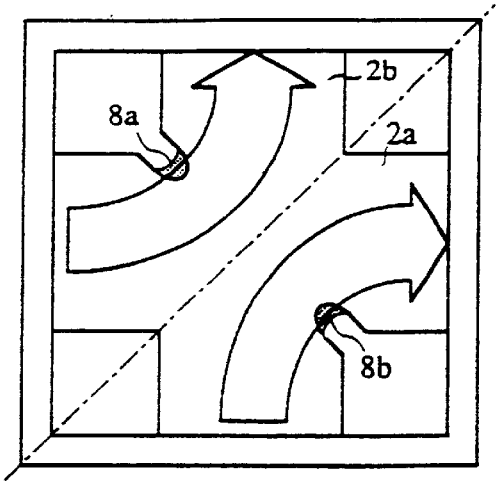
FIGS. 3A, 3B, and 3C are plan views of a multiple-mode dielectric resonator which represents a second embodiment of the present invention, showing electric field distributions of three resonance modes.
Figure 3B:
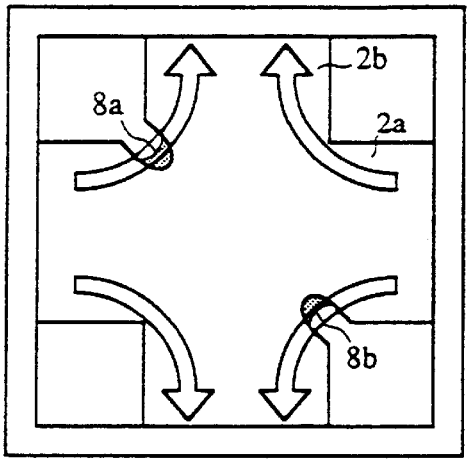
Figure 3C:
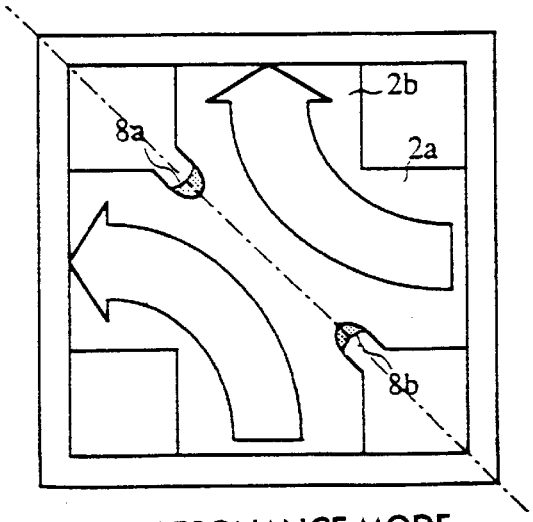

FIG. 3A, 3B, and 3C are plan views of a multiple-mode dielectric resonator which represents a second embodiment of the present invention, showing electric field distributions of the first, second, and third resonance modes, respectively. The resonant frequency of the first resonance mode in this dielectric resonator is determined by previously forming grooves corresponding to crisscross corner grooves 5*a* and 5*b* in the arrangement shown in FIGS. 1 and 2 (at a forming stage) and by applying a synthetic resin (adhesive) having a comparatively large dielectric constant and having an adhesive property to inner surface portions of the grooves. This synthetic resin is shown as dielectric portions 8*a* and 8*b*. For example, if the resonant frequency of the first resonance mode is set higher than the resonant frequencies of the other two resonance modes in the state before formation of dielectric portions 8*a* and 8*b*, it is possible to adjust the resonant frequency of the first resonance mode to a lower frequency by increasing the amount of the material of the dielectric portions 8*a* and 8*b*, and to adjust the resonant frequency of the first resonance mode to a frequency approximately equal to the resonant frequencies of the other two resonance modes by setting a certain amount of the material of the dielectric portions 8*a* and 8*b*. It is also possible to reduce the resonant frequency of the first resonance mode relative to the resonant frequencies of the other resonance modes by increasing the amount of the material of the dielectric portions 8*a* and 8*b*.

A dielectric material may applied to crossing corner portions or portions in the vicinity of the crossing corners of the dielectric block without grooves, such as those shown in FIGS. 3A to 3C, previously formed, thereby enabling the resonant frequency of the first resonance mode to be adjusted to a frequency lower than the resonant frequencies of the other two resonance modes.

Figure 4A:
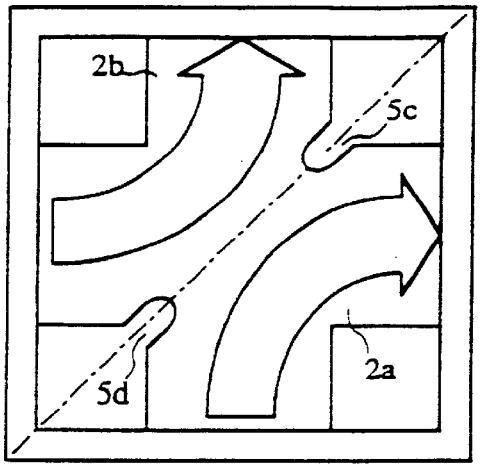
FIGS. 4A, 4B, and 4C are plan views of a multiple-mode dielectric resonator which represents a third embodiment of the present invention, showing electric field distributions of three resonance modes.
Figure 4B:
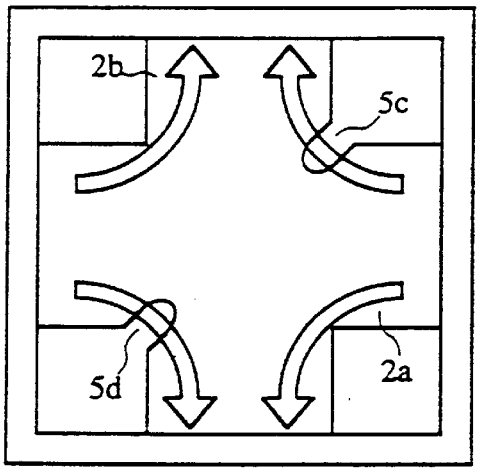
Figure 4C:
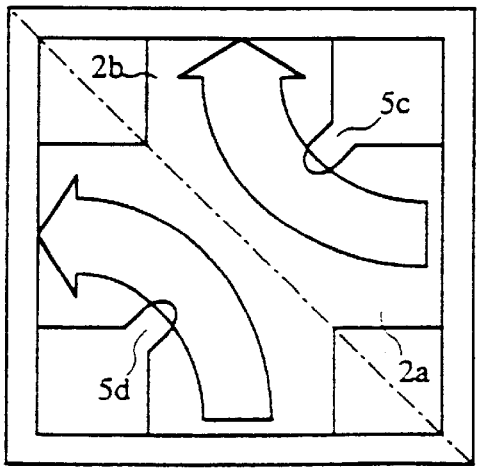

FIG. 4A, 4B, and 4C are plan views of a multiple-mode dielectric resonator which represents a third embodiment of the present invention, showing electric field distributions of the first, second, and third resonance modes, respectively. In this embodiment, in contrast with the relationship shown in FIGS. 2A to 2C, crisscross corner grooves 5*c* and 5*d* are formed in positions such as to be symmetrical about a diagonal line parallel to the electric field distribution of the third resonance mode (at positions on a diagonal line parallel to the electric field in the first resonance mode), and in two diagonal corner portions in four crossing corner portions of the combined dielectric block 2. Portions of the combined dielectric block 2 are selectively removed at positions where the electric field distribution of the third resonance mode is concentrated while the electric field distributions of the other two resonance modes is not substantially concentrated, thereby enabling the resonant frequency of the third resonance mode to be determined substantially independently.

Also in this embodiment, the crisscross corner grooves 5*c* and 5*d* may be formed simultaneously with integral formation of the cavity body and the combined dielectric block to adjust the resonant frequency of the third resonance mode to a value previously set at a design stage. Alternatively, the crisscross corner grooves 5*c* and 5*d* may be formed after integral formation of the cavity body and the combined dielectric block by cutting with a router or the like to adjust the resonant frequency to a target value.

A multiple-mode dielectric resonator which represents a fourth embodiment of the present invention will next be described with reference to FIGS. 5 and 6.

Figure 5:
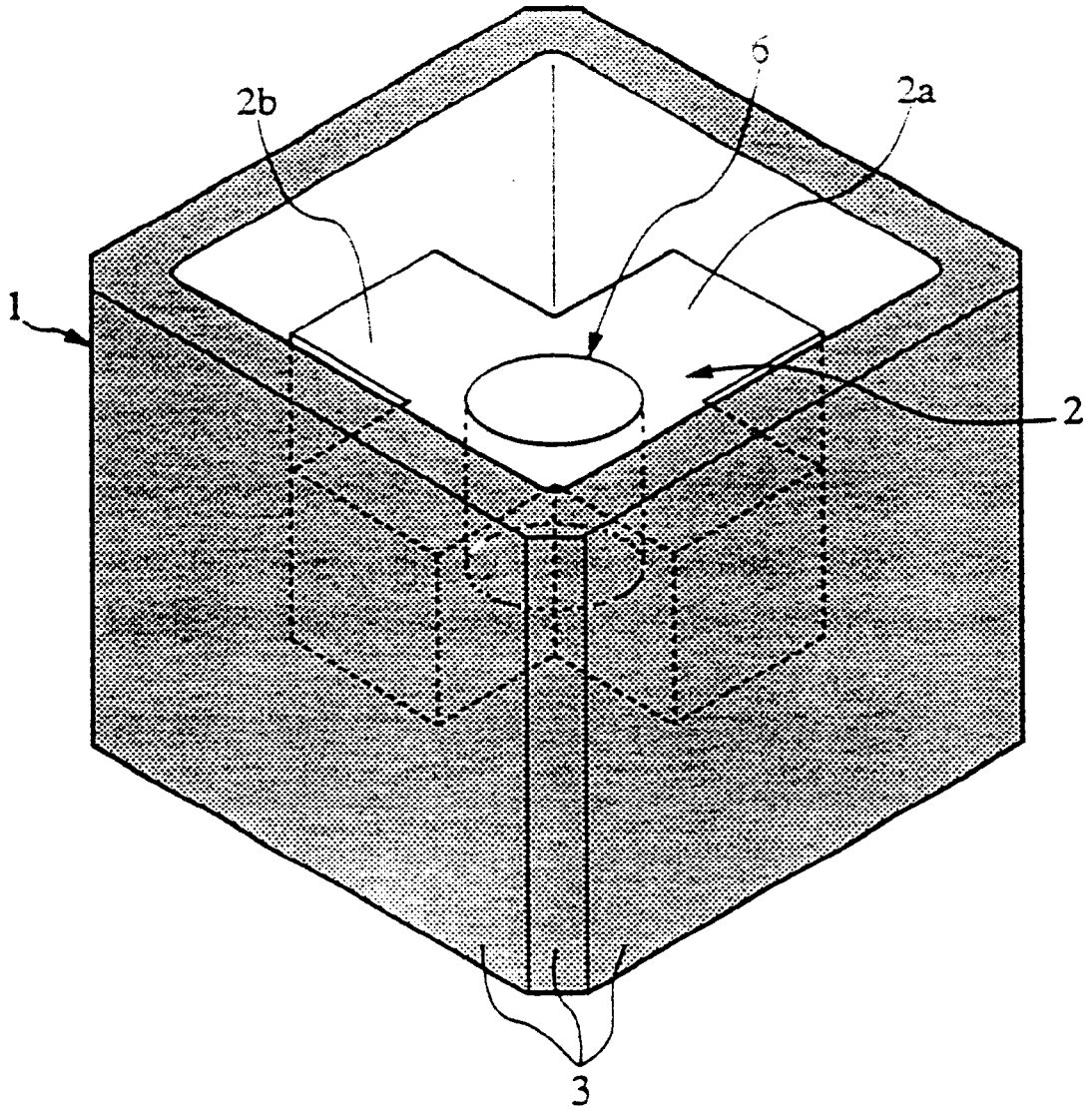
FIG. 5 is a perspective view of a multiple-mode dielectric resonator which represents a fourth embodiment of the present invention.

Referring to FIG. 5, which is a perspective view of the resonator, a combined dielectric block 2 formed of two dielectric elements 2*a* and 2*b* combined into a crossed shape is formed integrally with a cavity body 1 while being positioned inside the same, and a through hole having an axis in a direction perpendicular to major flat surfaces of the combined dielectric block 2 is formed as a dielectric-cut portion 6 in a central portion of the combined dielectric block 2. Such a through hole in a central portion of combined dielectric block 2 will hereinafter be referred to as "core center hole". A conductor 3 is formed on peripheral surfaces of the cavity body 1. Thus, a core center hole 6 is formed in a central portion of the combined dielectric block 2 to determine resonant frequency of the second resonance mode, as described below.

Figure 6A:
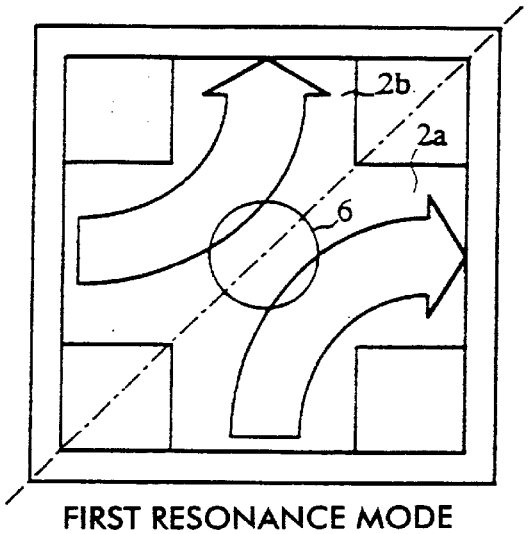
FIGS. 6A, 6B, and 6C are plan views of electric field distributions of three resonance modes in the dielectric resonator shown in FIG. 5.
Figure 6B:
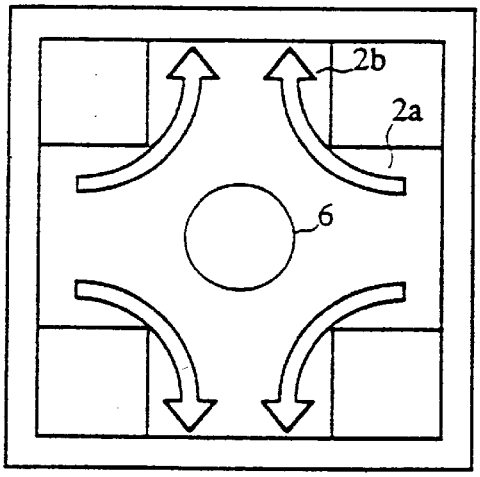
Figure 6C:
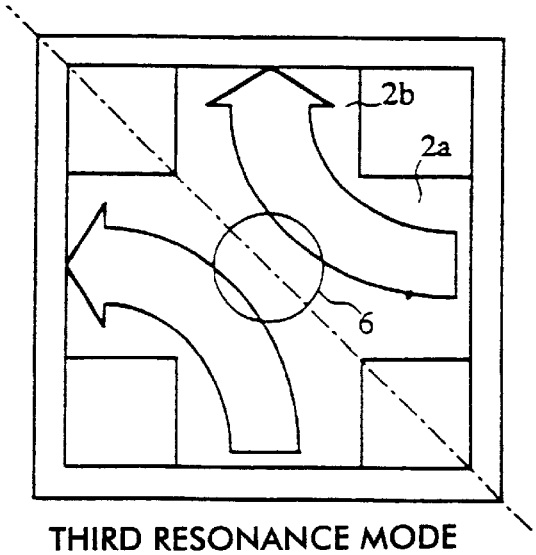

FIGS. 6A, 6B, and 6C are plan views schematically showing electric field distributions of the three resonance modes. If a central portion of the combined dielectric block is partially removed to form a core center hole 6 having a predetermined diameter, the resonant frequency of the second resonance mode can be determined independently. That is, the electric field distribution of the second resonance mode is sparse at the center of the combined dielectric block in comparison with the electric field distributions of the first and third resonance modes. Therefore, if the core center hole 6 is increased in size, each of the resonant frequencies of the first and second resonance modes becomes higher but the resonant frequency of the second resonance mode does not change largely. As a result, the resonant frequency of the second resonance mode can be determined relative to the resonant frequencies of the first and third resonance modes.

The above-described core center hole 6 may be formed simultaneously with integral formation of the cavity body and the combined dielectric block to adjust the resonant frequency of the second resonance mode to a value previously set at a design stage. Alternatively, the core center hole 6 may be formed after integral formation of the cavity body and the combined dielectric block by cutting with a router or the like to adjust the resonant frequency to a target value.

The core center hole 6 has been described as a through hole with respect to the embodiment shown in FIGS. 5 and 6A. The core center hole 6, however, may be a hole open at its one end and closed at the other end.

In the embodiment shown in FIGS. 5 and 6, the resonant frequency of the second resonance mode is adjusted in the increasing direction by increasing the amount of dielectric material removed. However, the arrangement may alternatively be such that a through hole or a hole with a closed bottom corresponding to the core center hole 6 is previously formed integrally in a central portion of the combined dielectric block shown in FIGS. 5 and 6, and a dielectric material is applied to an inner portion of the through hole or the hole with a closed bottom to simultaneously change the resonant frequencies of the first and third resonance modes in the reducing direction, thus relatively determining the resonant frequency of the second resonance mode.

A multiple-mode dielectric resonator which represents a fifth embodiment of the present invention will next be described with reference to FIGS. 7 and 8.

Figure 7:
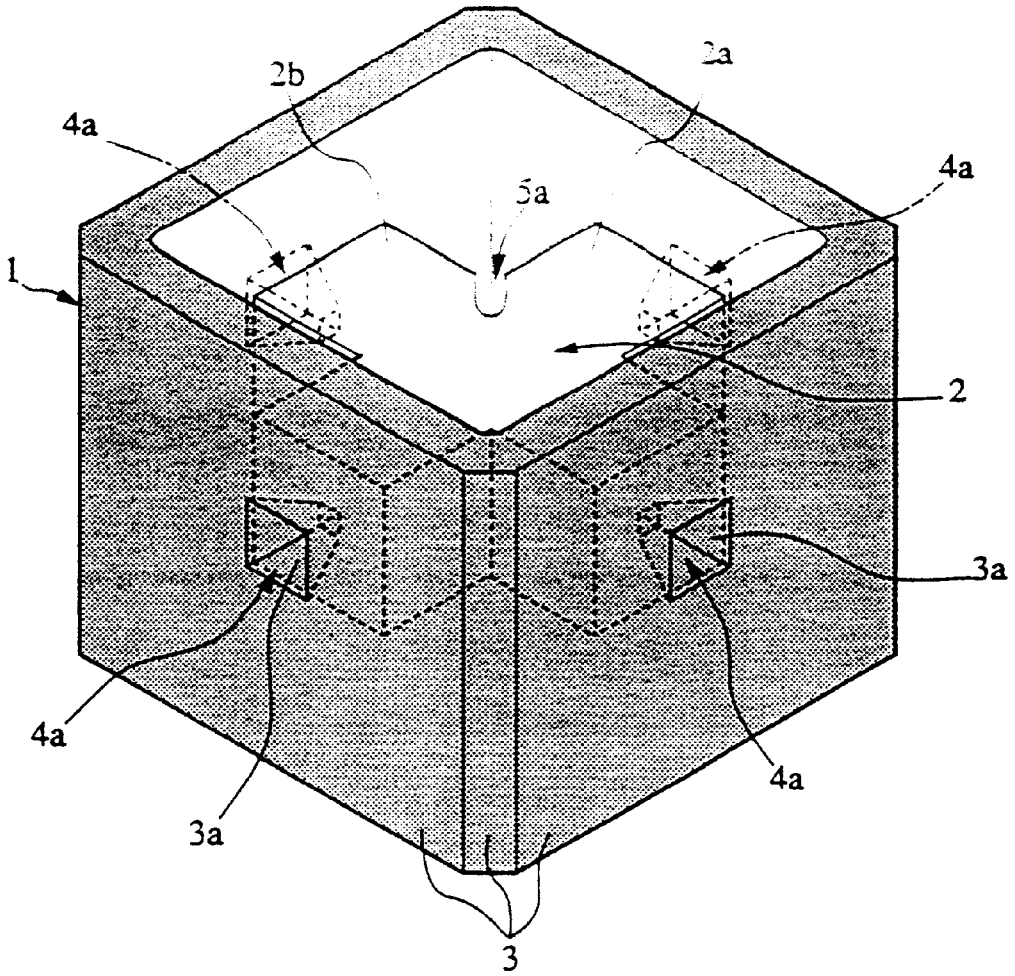
FIG. 7 is a perspective view of a multiple-mode dielectric resonator which represents a fifth embodiment of the present invention.

Referring to FIG. 7, which is a perspective view of the resonator, a combined dielectric block 2 formed of two dielectric elements 2*a* and 2*b* combined into a crossed shape is formed integrally with a cavity body 1 while being positioned inside the same. At a center of each of end surfaces of the dielectric elements 2*a* and 2*b* connected to the cavity body 1, a hole 4*a* is formed in the outer surface of the cavity body 1 so as to extend to an inner portion of the dielectric element 2*a* or 2*b*, and a conductor 3*a* is formed on inner surfaces of each hole 4*a*. This conductor 3*a* connects to a conductor 3 formed on peripheral surfaces of the cavity body 1. A predetermined one of four crossing corner portions of the combined dielectric block 2 is partially cut to form a crisscross corner grooves 5*a*. By this means, coupling between the first and second resonance modes is caused and the degree of this coupling is determined, as described below.

Figure 8A:
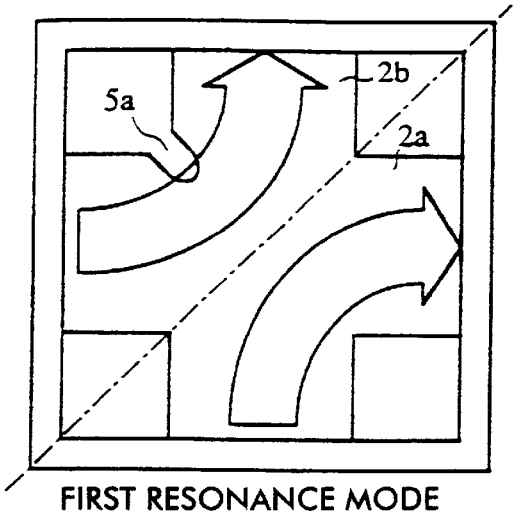
FIGS. 8A, 8B, and 8C are plan views of electric field distributions of three resonance modes in the dielectric resonator shown in FIG. 7.
Figure 8B:
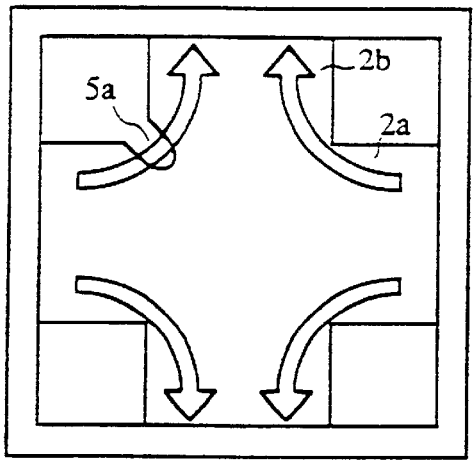
Figure 8C:
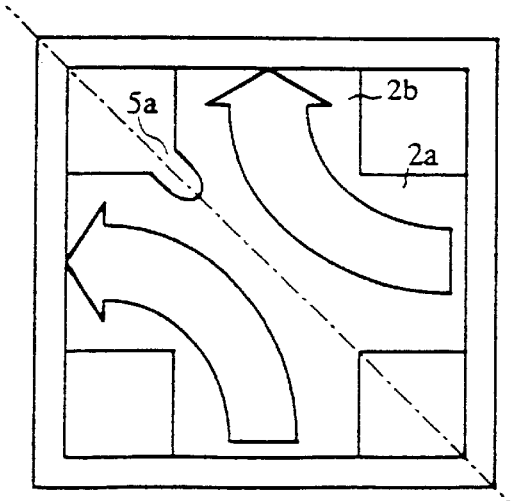

FIGS. 8A, 8B, and 8C are plan views of the multiple-mode dielectric resonator shown in FIG. 7, schematically showing electric field distributions of the three resonance modes in the resonator. The crisscross corner groove 5*a* is formed on the line of symmetry of the electric field distribution of the third resonance mode and at only one of two positions on the opposite sides of a diagonal line along the electric field distribution of the first resonance mode such as to avoid symmetry about a line corresponding to this diagonal line. If the crisscross corner groove 5*a* is not formed, the electric field distribution of the first resonance mode is uniform with respect to the direction of the electric field parallel to the line of symmetry corresponding to the diagonal line of the combined dielectric block while the electric field distribution of the second resonance mode is reversed in direction with respect to the line of symmetry of the electric field distribution of the first resonance mode. If the combined dielectric block is perfectly symmetrical about the line of symmetry of the electric field distribution of the first resonance mode, excitation of the second resonance mode by the electromagnetic field of the first resonance mode is canceled by phase opposition about the plane of symmetry, so that no resonance in the second resonance mode is excited. If the crisscross corner groove 5*a* is formed, the symmetry of the combined dielectric block is reduced and resonance in the second resonance mode is excited by the electromagnetic field of the first resonance mode, thus causing coupling between the first resonance mode and the second resonance mode. The degree of coupling between the two modes is determined by the size of the crisscross corner groove 5*a*. In this situation, in the relationship between the second resonance mode and the third resonance mode, the symmetry of the combined dielectric block about a line corresponding to the diagonal line parallel to the electric field distribution of the third resonance mode is maintained although the crisscross corner groove 5*a* is formed. Therefore, no coupling occurs between the second resonance mode and the third resonance mode.

The above-described crisscross corner groove 5*a* may be formed simultaneously with integral formation of the cavity body 1 and the combined dielectric block 2 to adjust the degree of coupling between the first and second resonance modes to a value previously set at a design stage. Alternatively, the crisscross corner groove 5*a* may be formed after integral formation of the cavity body 1 and the combined dielectric block 2 by cutting with a router or the like to adjust the degree of coupling to a target value.

Another process is also possible in which a groove is previously formed in a portion corresponding to the crisscross groove 5*a* in the structure shown in FIGS. 7 and 8 at a forming stage, and a dielectric material is applied to an inner portion of the groove to determine the degree of coupling between the first and second resonance modes.

Figure 9A:
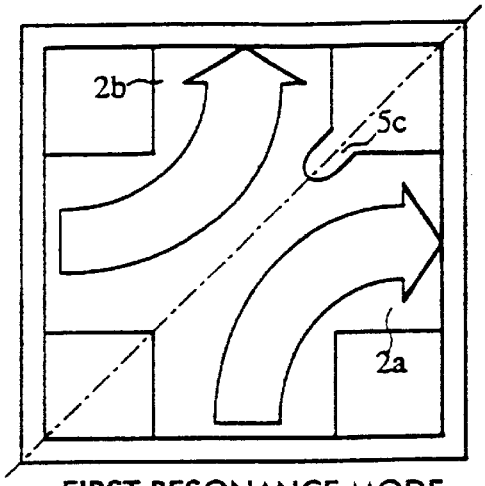
FIGS. 9A, 9B, and 9C are plan views of a multiple-mode dielectric resonator which represents a sixth embodiment of the present invention, showing electric field distributions of three resonance modes.
Figure 9B:
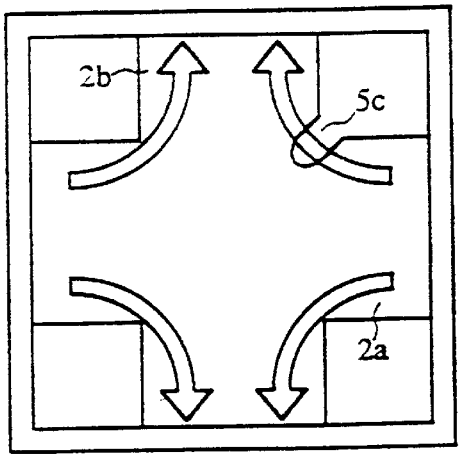
Figure 9C:
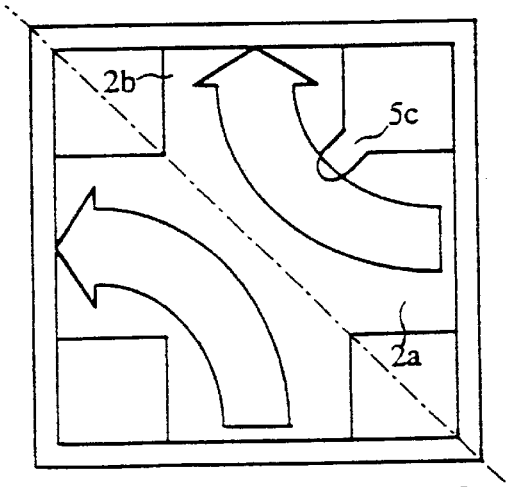

FIG. 9 is a plan view of a multiple-mode dielectric resonator which represents a sixth embodiment of the present invention. In this embodiment, in contrast with the embodiment shown in FIGS. 7 and 8, a crisscross corner groove 5*c* is formed on the line of symmetry of the electric field distribution of the first resonance mode and at only one of two positions on the opposite sides of a diagonal line along the electric field distribution of the third resonance mode such as to avoid symmetry about a line corresponding to this diagonal line, thereby determining the degree of coupling between the second and third resonance modes in the same manner as in the fifth embodiment.

The crisscross corner groove 5*c* may be formed simultaneously with integral formation of the cavity body and the combined dielectric block to adjust the degree of coupling between the second and third resonance modes to a value previously set at a design stage. Alternatively, the crisscross corner groove 5*c* may be formed after integral formation of the cavity body and the combined dielectric block by cutting with a router or the like to adjust the degree of coupling to a target value.

A multiple-mode dielectric resonator which represents a seventh embodiment of the present invention will next be described with reference to FIGS. 10 through 12.

Figure 10:
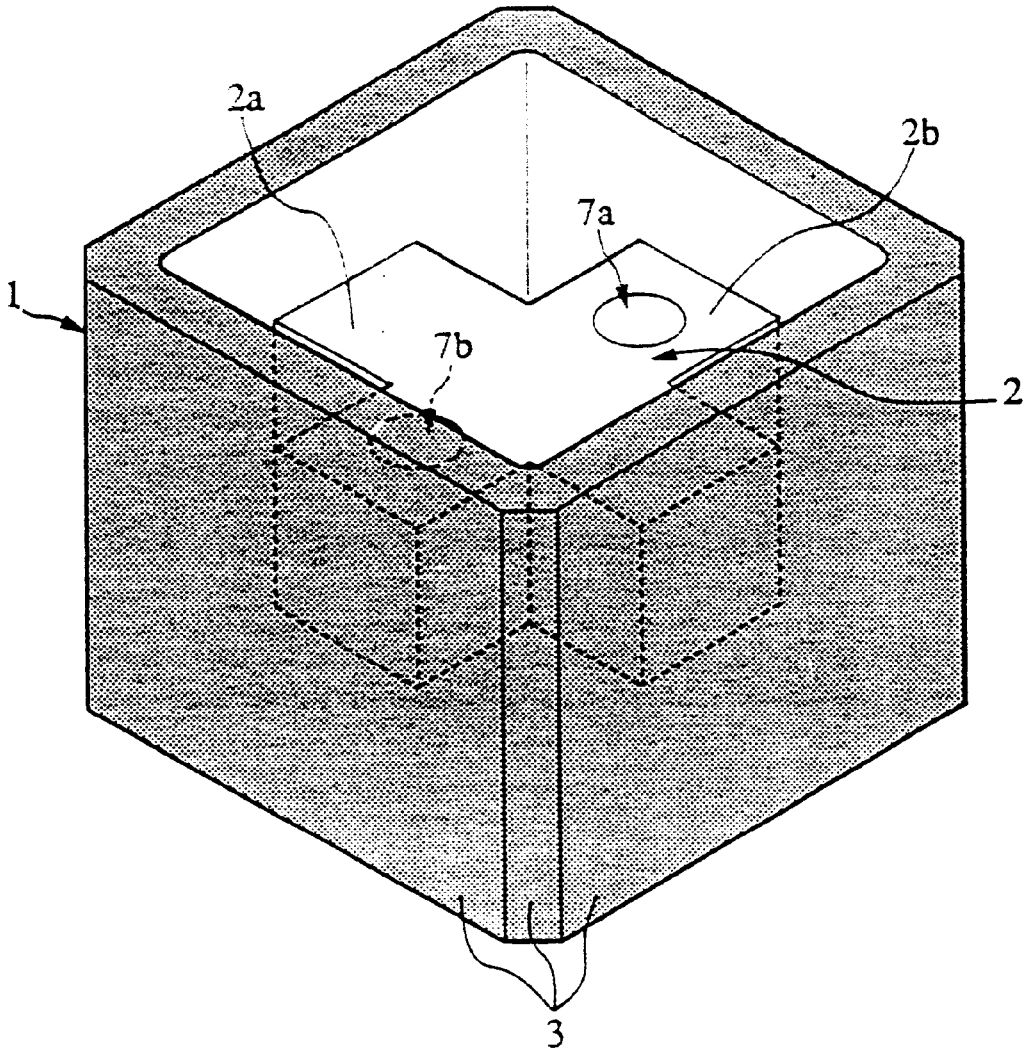
FIG. 10 is a perspective view of a multiple-mode dielectric resonator which represents a seventh embodiment of the present invention.

Referring to FIG. 10, which is a perspective view of the multiple-mode dielectric resonator, dielectric-cut portions 7*a* and 7*b* are formed in the dielectric element 2*b* at two positions on the cavity-wall sides. Such a hole on the cavity-wall side will hereinafter be referred to as "wall-side center hole". By such means, the degree of coupling between the first and third resonance modes is determined, as described below.

Figure 11A:
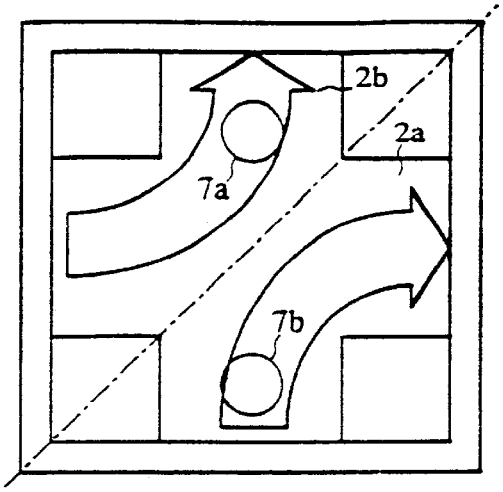
FIGS. 11A, 11B, and 11C are plan views of electric field distributions of three resonance modes in the dielectric resonator shown in FIG. 10.
Figure 11B:
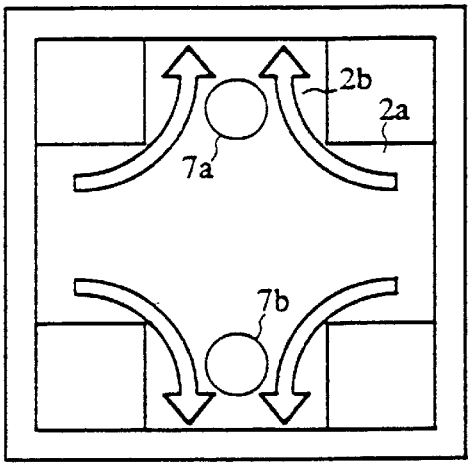
Figure 11C:
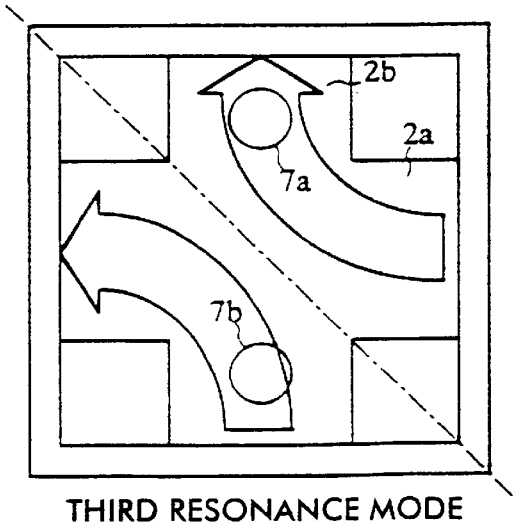
Figure 12A:
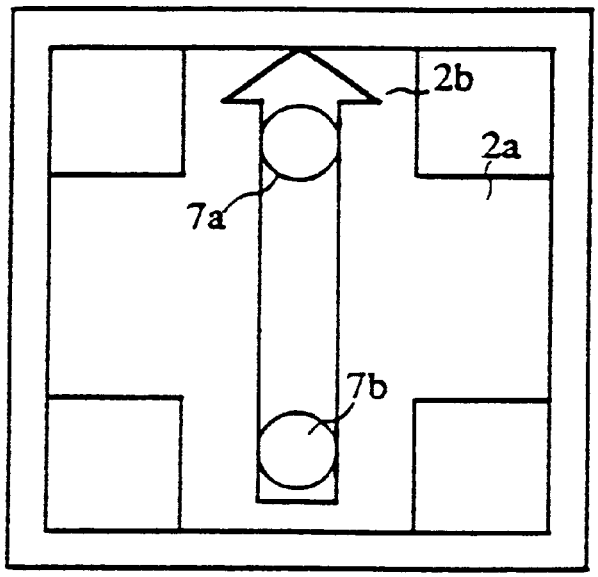
FIGS. 12A and 12B are diagrams showing coupling modes in the multiple-mode dielectric resonator of the seventh embodiment of the present invention.
Figure 12B:
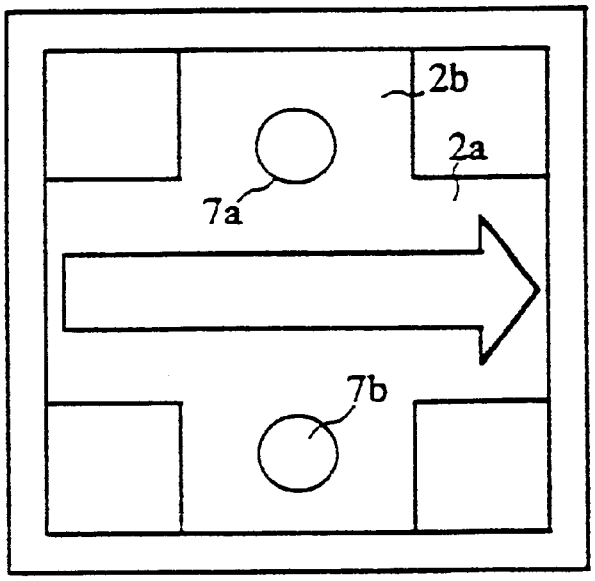

FIGS. 11A, 11B, and 11C are plan views of the multiple-mode dielectric resonator shown in FIG. 10, schematically showing electric field distributions of the three resonance modes in the resonator. If the first resonance mode and the third resonance mode are superposed on each other, a $TM^{Y}_{110}$ mode in which an electric field is distributed in a longitudinal direction as viewed in FIG. 12A and a $TM^{X}_{110}$ mode in which an electric field is distributed in a lateral direction as viewed in FIG. 12B can result. That is, the $TM^{Y}_{110}$ mode and the $TM^{X}_{110}$ mode correspond to (First Resonance Mode+Third Resonance Mode) and (First Resonance Mode−Third Resonance Mode), respectively, of the directions of the electric field distributions of the first and third resonance modes shown in FIGS. 11A and 11C. If the resonant frequency of the $TM^{Y}_{110}$ mode is "$f_{lon}$" and the resonant frequency of the $TM^{X}_{110}$ mode is "$f_{lat}$" then a coefficient k of coupling between the first and third resonance modes is shown by $$k=2|f_{lon}-f_{lat}|/(f_{lon}+f_{lat})$$

Since in this embodiment wall-side center holes 7*a* and 7*b* are formed in the dielectric element 2*b* in the longitudinal direction as viewed in FIG. 12, "$f_{lon}$" is increased relative to "$f_{lat}$" to cause a difference between the two frequencies, thereby enabling coupling between the first and third resonance modes. The degree of coupling therebetween can be determined by selecting the size of the wall-side center holes 7*a* and 7*b*.

The above-described wall-side center holes 7*a* and 7*b* may be formed simultaneously with integral formation of the cavity body 1 and the combined dielectric block 2 to adjust the degree of coupling between the first and third resonance modes to a value previously set at a design stage. Alternatively, the wall-side center holes 7*a* and 7*b* may be formed after integral formation of the cavity body 1 and the combined dielectric block 2 by cutting with a router or the like to adjust the degree of coupling to a target value.

Another process is also possible in which through holes or holes with closed bottoms are previously formed in portions corresponding to the wall-side center holes 7*a* and 7*b* shown in FIGS. 10 to 12, and a dielectric material is applied to inner surfaces of the through holes or holes with closed bottoms to determine the degree of coupling between the first and third resonance modes.

In the embodiment shown in FIG. 10, the outer surfaces of the cavity body 1 corresponding to the opposite end surfaces of the dielectric elements 2*a* and 2*b* are flat. However, the arrangement may alternatively be such that a hole is formed in each of the outer surfaces of the cavity body 1 at a center of the corresponding end surface of the dielectric element 2*a* or 2*b* connected to the cavity body 1 so as to extend to an inner portion of the dielectric element 2*a* or 2*b*, and a conductor is formed on inner surfaces of each hole.

A multiple-mode dielectric resonator which represents an eighth embodiment of the present invention will next be described with reference to FIGS. 13 and 14.

Figure 13A:
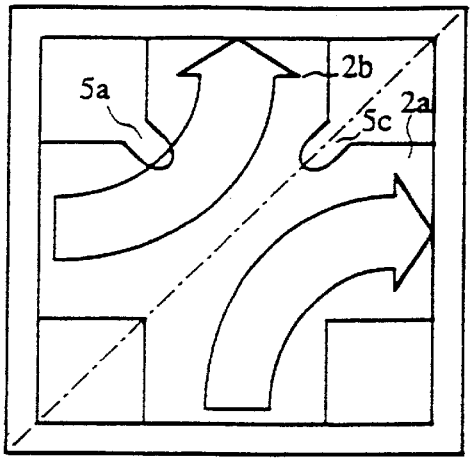
FIGS. 13A, 13B, and 13C are plan views of a multiple-mode dielectric resonator which represents an eighth embodiment of the present invention, showing electric field distributions of three resonance modes.
Figure 13B:
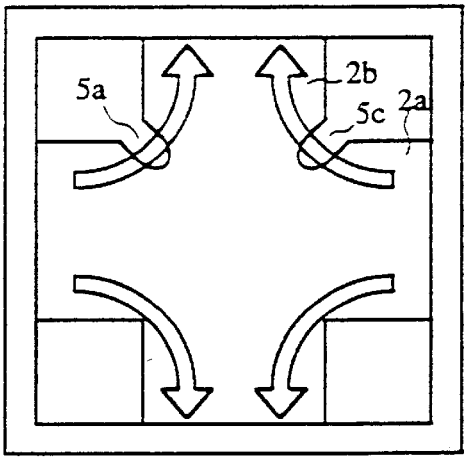
Figure 13C:
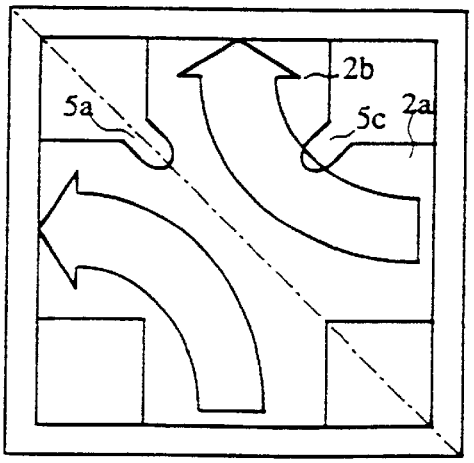

Referring to FIGS. 13A, 13B, and 13C, which are plan views schematically showing electric field distributions of the three resonance modes, crisscross corner grooves 5*a* and 5*c* are formed in predetermined two corner portions adjacent to each other and not in a diagonal relationship in four corner portions of the combined dielectric block formed by the two dielectric elements crossing each other.

These crisscross corner grooves 5*a* and 5*c* have the same functions as that indicated by 5*a* in FIG. 8 and that indicated by 5*c* in FIG. 9, respectively. That is, the crisscross corner grooves 5*a* enables coupling between the first and second resonance modes while the crisscross corner grooves 5*c* enables coupling between the second and third resonance modes. Couplings between the three resonance modes occur successively in the order of the first resonance mode→the second resonance mode→the third resonance mode or in the reverse of this order. The crisscross corner grooves 5*a* and 5*c* evenly influence the two coupling modes shown in FIGS. 12A and 12B, which are resultants of the first and third resonance modes, so that no difference is caused between the resonant frequencies of the $TM^{Y}_{110}$ mode and the $TM^{M}_{110}$ mode. Therefore, no coupling occurs between the first and third resonance modes.

The above-described crisscross corner grooves 5*a* and 5*c* may be formed simultaneously with integral formation of the cavity body and the combined dielectric block to adjust the degree of coupling between the first and second resonance modes and the degree of coupling between the second and third resonance modes to values previously set at a design stage. Alternatively, the crisscross corner grooves 5*a* and 5*c* may be formed after integral formation of the cavity body and the combined dielectric block by cutting with a router or the like to adjust the degrees of coupling to target values.

Figure 14A:
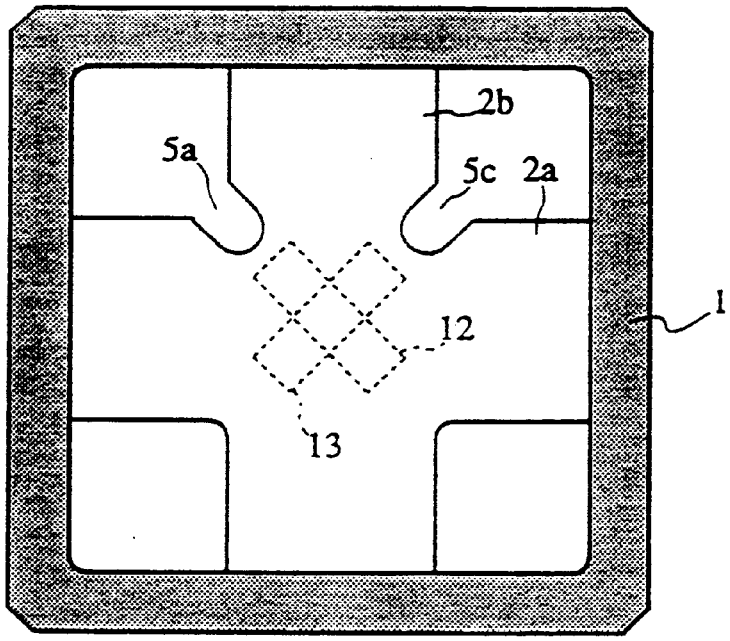
FIGS. 14A and 14B are a plan view and a cross-sectional view, respectively, of the multiple-mode dielectric resonator shown in FIGS. 13A to 13C, FIG. 14B showing in a state where conductor plates are attached.
Figure 14B:
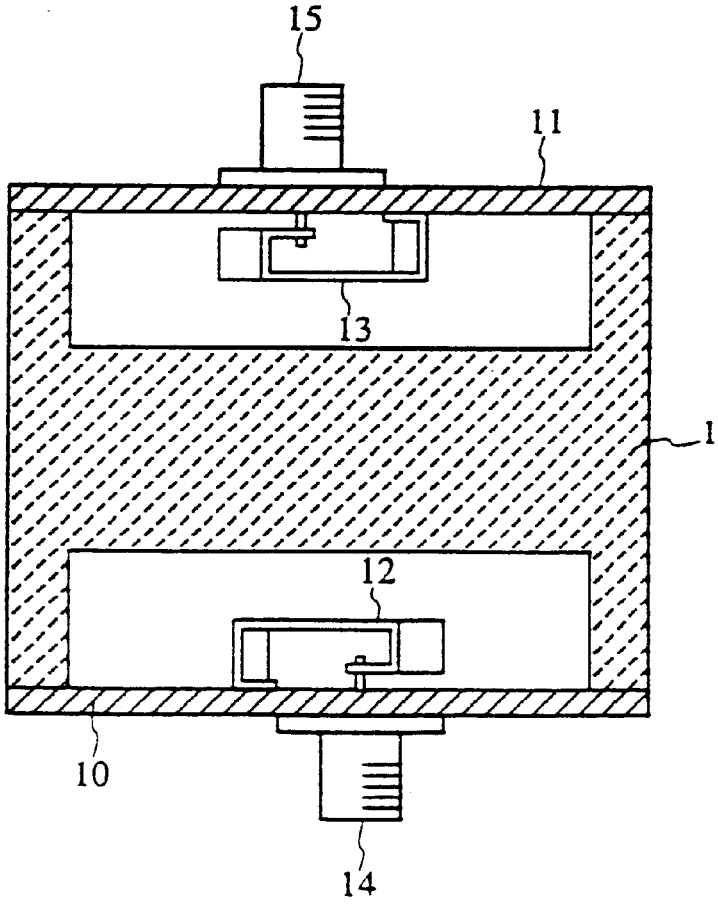

FIGS. 14A and 14B show an example of a band-pass filter which is formed of a three-stage resonator, and which is constructed by attaching external coupling loops and coaxial connectors to the above-described multiple-mode dielectric resonator. FIG. 14A is a plan view of a state before conductor plates are attached to the opening end portions of the cavity body, and FIG. 14B is a longitudinal sectional view from the front side. Coaxial connectors 14 and 15 are attached to outer surfaces of conductor plates 10 and 11 with which the upper and lower openings of the cavity body 1 are covered while coupling loops 12 and 13 are attached to inner surfaces of the conductor plates 10 and 11. The coupling loops 12 and 13 are disposed so as to form an angle of 45° with each of the dielectric elements of the combined dielectric block as viewed in FIG. 14A. Therefore, as is apparent from reference to FIGS. 13A and 13C, the coupling loop 13 couples to the first resonance mode by magnetic field coupling while the coupling loop 12 couples to the third resonance mode by magnetic field coupling. Consequently, a dielectric filter which is formed of a three-stage resonator having the first to third resonance modes shown in FIGS. 13A to 13C and which has a band-pass filter characteristic is formed between the coaxial connectors 14 and 15.

Figure 15A:
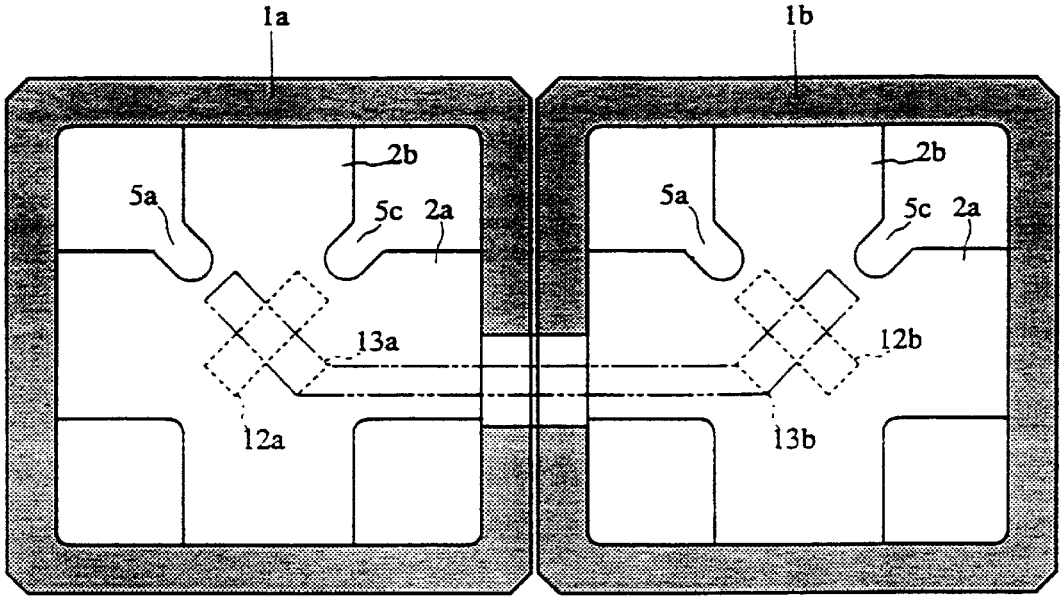
FIGS. 15A and 15B are cross-sectional views of a dielectric filter which presents a ninth embodiment of the present invention.
Figure 15B:
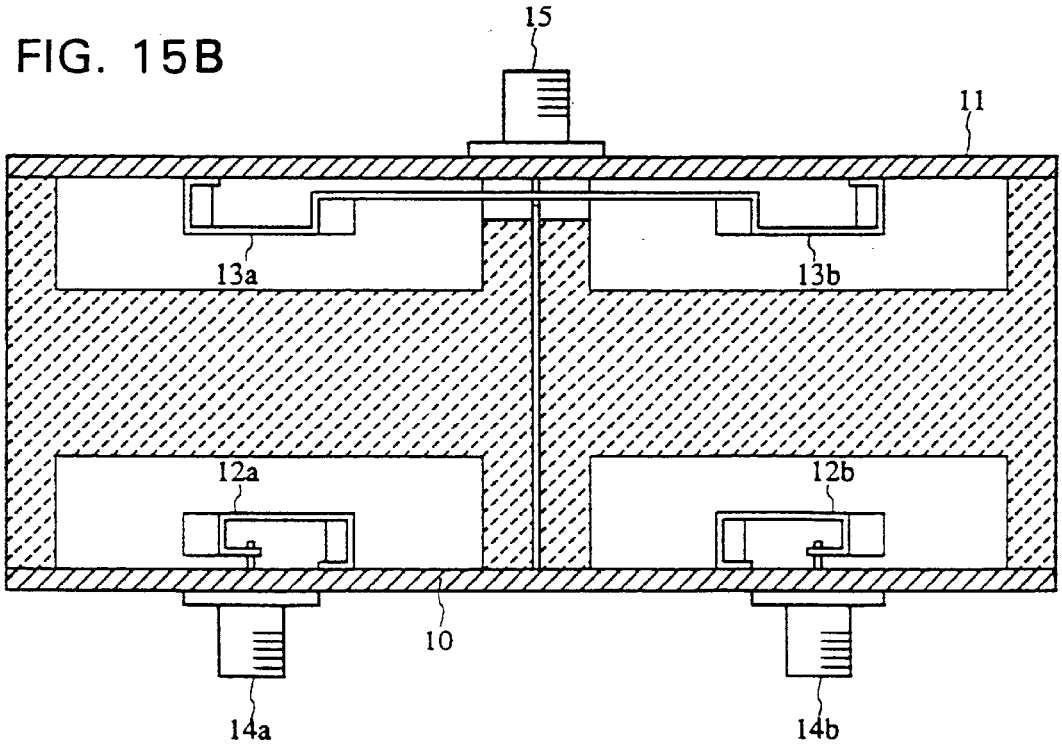

The structure of an antenna-sharing device which represents a ninth embodiment of the present invention will next be described with reference to FIGS. 15A and 15B. While in the arrangement shown in FIG. 14 a dielectric filter formed of a three-stage resonator and having a band-pass filter characteristic is formed by preparing one combined dielectric block, two combined dielectric elements are used in the ninth embodiment to form an antenna-sharing device. FIG. 15A is a plan view of a state before conductor plates are attached to the opening end portions of the cavity bodies, and FIG. 15B is a longitudinal sectional view from the front side. Coaxial connectors 14*a*, 14*b*, and 15 are attached to outer surfaces of conductor plates 10 and 11 with which the upper and lower openings of the cavity bodies 1*a* and 1*b* are covered while coupling loops 12*a*, 12*b*, 13*a*, and 13*b* are attached to inner surfaces of the conductor plates 10 and 11. these coupling loops are disposed so as to form an angle of 45° with each of the dielectric elements of the combined dielectric block as viewed in FIG. 15A. In this structure, two dielectric filters each constructed as shown in FIGS. 14A and 14B are formed. For example, one of these filters on the left-hand side of FIG. 15A or 15B is used as a transmitting filter, and the other filter on the right-hand side is used as a receiving filter.

As shown in FIG. 15B, one end of the coupling loop 13*a* and one end of the coupling loop 13*b* are connected to each other and a core conductor of the coaxial connector 15 is connected to the conductor connecting the coupling loops 13*a* and 13*b* at a predetermined intermediate position. Each of the lengths of the conductor portions between the point of connection of the center core of the coaxial connector 15 (branching point) and the coupling loops 13*a* and 13*b* is set to such a value that the impedance of the transmitting filter or receiving filter seen from the branching point is sufficiently large.

The thus-constructed device can be used as an antenna-sharing device with the coaxial connector 14*a* used as a transmitted signal input terminal, the coaxial connector 14*b* used as a received signal output terminal, and the coaxial connector 15 used as an antenna connection terminal.

In the embodiment shown in FIGS. 15A and 15B, a transmitting filters and a receiving filter each formed of a three-stage dielectric resonator are provided. However, a plurality of dielectric filters may be successively connected to form an antenna-sharing device formed of a larger number of dielectric device stages.

Also, input/output-sharing devices having at least three sections each used as an input or output section can generally be constructed in the same manner as well as the above-described antenna-sharing device.

A multiple-mode dielectric resonator which represents a tenth embodiment of the present invention will next be described with reference to FIG. 16. Each of the above-described embodiments of the present invention is a triple-mode dielectric resonator having a combined dielectric block formed of two dielectric elements combined into a crossed shape, and using two TM110 modes and one TM111 mode. In the tenth embodiment described below, a combined dielectric block formed of three dielectric elements combined into a crossed shape is used.

Figure 16:
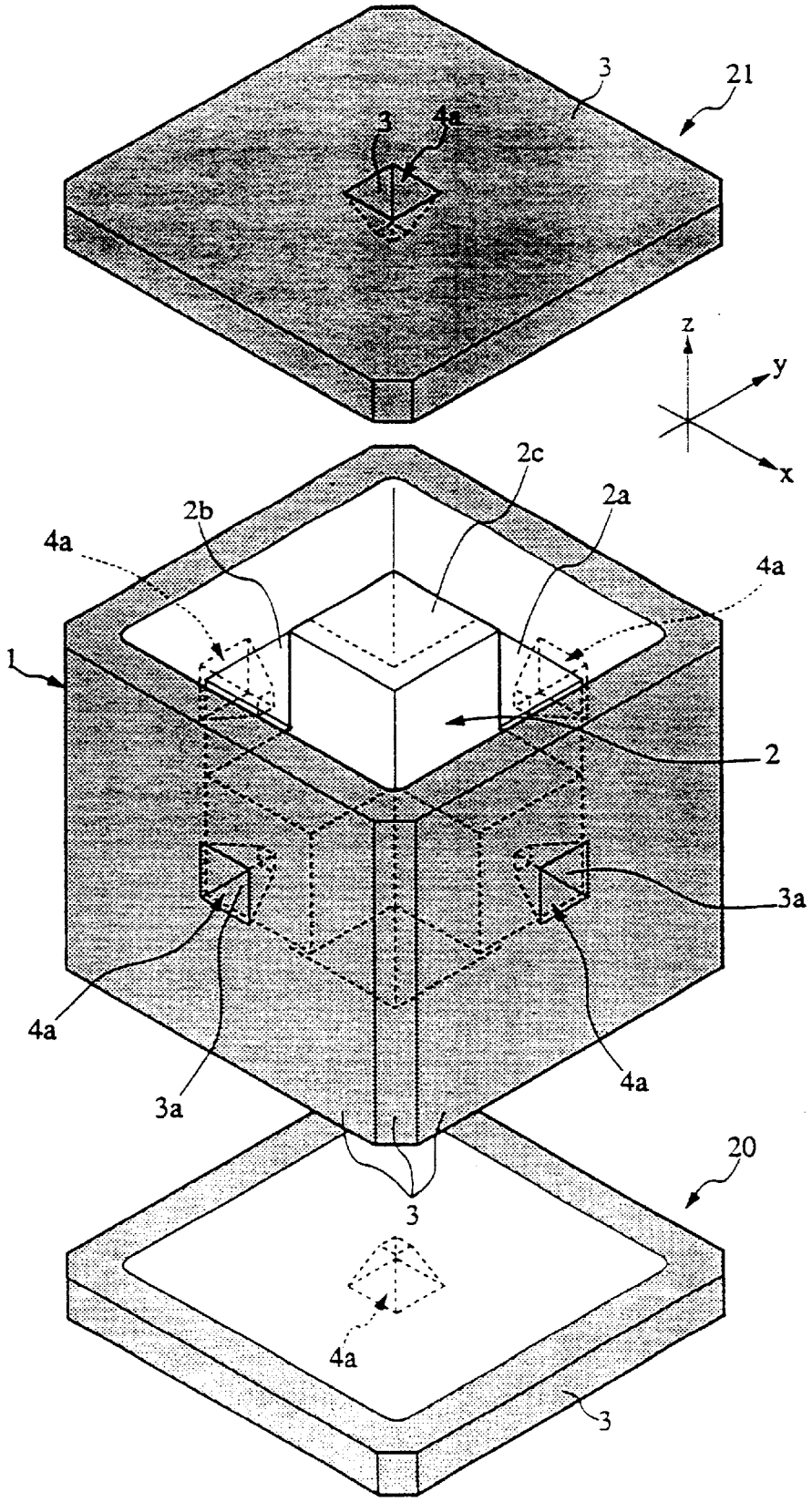
FIG. 16 is an exploded perspective view of a multiple-mode dielectric resonator which represents a tenth embodiment of the present invention.

As shown in FIG. 16, a combined dielectric block 2 formed of three dielectric elements 2*a*, 2*b*, and 2*c* combined into a crossed shape is formed integrally with a cavity body 1 while being positioned in the same. At a center of each of end surfaces of the dielectric elements 2*a* and 2*b* connected to the cavity body 1, a hole 4*a* is formed in the outer surface of the cavity body 1 so as to extend to an inner portion of the dielectric element 2*a* or 2*b*, and a conductor 3*a* is formed on inner surfaces of each hole 4*a*. This conductor 3*a* connects to a conductor 3 formed on peripheral surfaces of the cavity body 1. The upper and lower opening end surfaces of the cavity body 1 are covered with dielectric plates 20 and 21. Conductor 3 is formed on the surfaces of the dielectric plates 20 and 21 which form outer surfaces when the dielectric plates 20 and 21 are attached to the opening end surfaces of the cavity body 1. Conductor 3 is also formed on portions of the dielectric plates 20 and 21 brought into contact with the cavity opening end surfaces. In portions of the dielectric plates 20 and 21 opposite from the end surfaces of the dielectric element 2*c*, holes 4*a* are formed so as to extend inwardly along the axial direction of the dielectric element 2*c*. Conductor 3*a* is also formed on inner surfaces of these holes 4*a*. The conductor 3*a* in each of these holes 4*a* connects to the conductor 3 formed on the dielectric plates 20 and 21. Each of the dielectric plates 20 and 21 is connected to the opening end surface of the cavity body by Ag paste application and backing or by soldering or the like.

If a combined dielectric block formed of three dielectric elements combined into a crossed shape is provided as described above, two TM110 modes ($TM_{110}^{X}$ mode and $TM_{110}^{Y}$ mode) are caused by the two dielectric elements 2*a* and 2*b* and one TM110 mode ($TM_{110}^{XY}$ mode) is also caused along a plane defined by the dielectric elements 2*a* and 2*b*. Similarly, two TM110 modes ($TM_{110}^{Y}$ mode and $T_{110}^{Z}$ mode) are caused by the two dielectric elements 2*a* and 2*c* and one TM111 mode ($TM_{111}^{YZ}$ mode) is also caused along a plane defined by the dielectric elements 2*a* and 2*c*. Further, two TM110 modes ($TM_{110}^{X}$ mode and $TM_{110}^{Z}$ mode) are caused by the two dielectric elements 2*b* and 2*c* and one $TM_{111}$ mode ($TM_{111}^{XZ}$ mode) is also caused along a plane defined by the dielectric elements 2*b* and 2*c*. Consequently, this dielectric resonator functions as a sextuple dielectric resonator. With respect to the three resonance modes (two TM110 modes and one TM111 mode) along the plane defined by two of the three dielectric elements, setting of the resonant frequency of each resonator or coupling between the resonators can be performed in the same manner as those described with respect to the first to eighth embodiments. However, each of the resonant frequencies of the six resonance modes cannot be set independent of the others and the resonators cannot be coupled one after another. Then, for example, predetermined resonators in the six resonators may be successively coupled to function as a band-pass filter formed of a multi-stage resonator, and the other resonators may be made to function independently as traps. In this manner, a band-pass filter having attenuation poles at predetermined frequencies can be formed.

Examples of the method of designing or adjustment method for relatively changing the resonant frequencies of two TM110 mode and one TM111 mode to obtain desired resonant frequencies will next be described with reference to FIGS. 17 to 22.

Figure 17A:
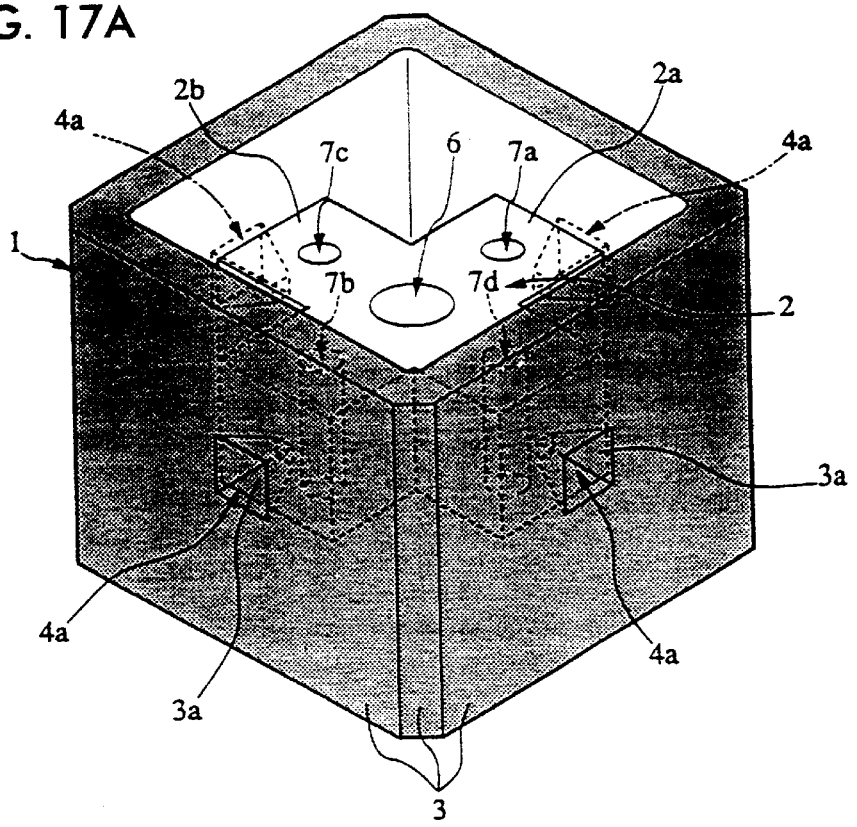
FIGS. 17A and 17B are an exploded perspective view and a graph, respectively, of a multiple-mode dielectric resonator which represents an eleventh embodiment of the present invention, the graph showing characteristics of changes in resonant frequency.
Figure 17B:
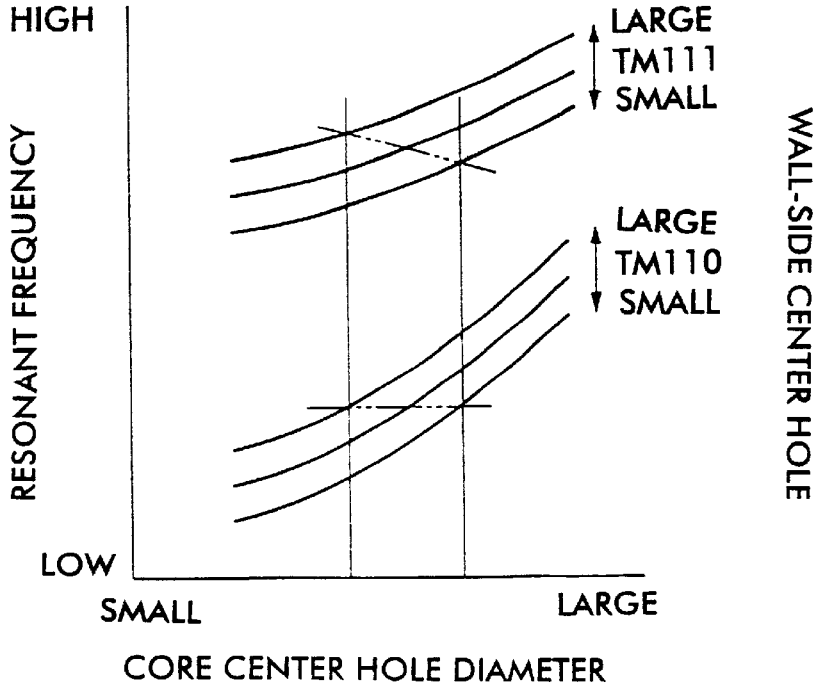

FIG. 17A is a perspective view of the structure of a multiple-mode dielectric resonator which represents an eleventh embodiment of the present invention, and FIG. 17B is a graph showing resonant frequency change characteristics of the multiple-mode dielectric resonator. As shown in FIG. 17A, a combined dielectric block 2 formed of two dielectric elements 2*a* and 2*b* combined into a crossed shape is formed integrally with a cavity body 1 while being positioned inside the same. At a center of each of end surfaces of the dielectric elements 2*a* and 2*b* connected to the cavity body 1, a hole 4*a* is formed in the outer surface of the cavity body 1 so as to extend to an inner portion of the dielectric element 2*a* or 2*b*, and a conductor 3*a* is formed on inner surfaces of each hole 4*a*. A core center hole 6 is formed in a central portion of the combined dielectric block 2, and wall-side center holes 7*a*, 7*b*, 7*c*, and 7*d* are formed in the dielectric elements 2*a* and 2*b*.

FIG. 17B shows changes in the resonant frequencies of a TM110 mode and a TM111 mode with respect to changes in the inside diameter of the core center hole 6 with the inside diameter of the wall-side center holes 7*a* to 7*d* used as a parameter. If the inside diameter of the core center hole is increased, the resonant frequency of each mode becomes higher. At the center of the combined dielectric block 2, the electric field distribution of the TM110 mode has a degree of concentration higher than that of the electric field distribution of the TM111 mode. Therefore, the rate of change in the resonant frequency of the TM110 mode with respect to changes in the inside diameter of the core center hole 6 is higher than that of the TM111 mode. On the other hand, the resonant frequencies of the TM110 mode and the TM111 mode change substantially at the same rate with respect to changes in the inside diameter of the wall-side center holes 7*a* to 7*d*. Then, when both the inside diameter of the core center hole 6 and the inside diameter of the wall-side center holes 7*a* to 7*d* are changed so that the resonant frequency of the TM110 mode is constant as indicated by the double-dot-dash line, the resonant frequency of the TM111 mode is not constant and changes as shown in the graph. By using this relationship, the resonant frequency of the TM110 mode and the resonant frequency of the TM111 mode can be determined relative to each other. For example, if a band-pass filter is formed by using two TM110 modes (with a TM111 mode treated as a spurious mode), the resonant frequency of a TM111 mode may be determined relative to the resonant frequencies of the TM110 modes so as to obtain a desired attenuation characteristic. For coupling between the TM110 modes and TM111 mode, the core center hole 6 is enlarged or the core center hole 6 and the wall-side center holes 7*a* to 7*d* are enlarged to bring the resonant frequencies of the TM110 mode closer to the resonant frequency of the TM111 mode so that the frequencies of the two modes are approximately equal to each other.

Figure 18A:
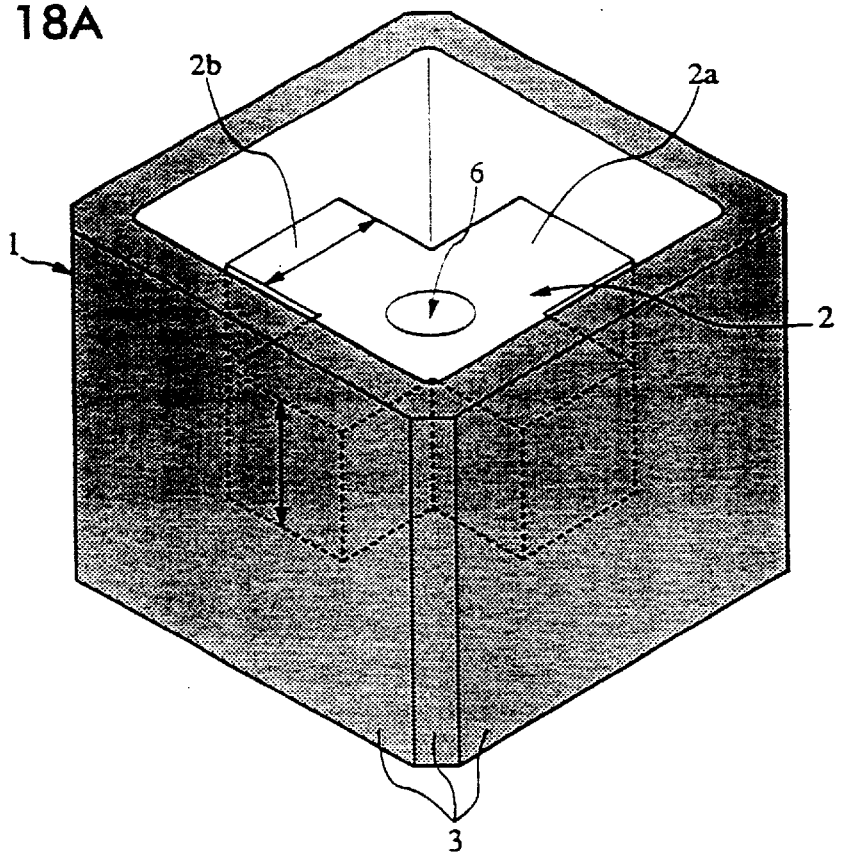
FIGS. 18A and 18B are an exploded perspective view and a graph, respectively, of a multiple-mode dielectric resonator which represents a twelfth embodiment of the present invention, the graph showing characteristics of changes in resonant frequency.
Figure 18B:
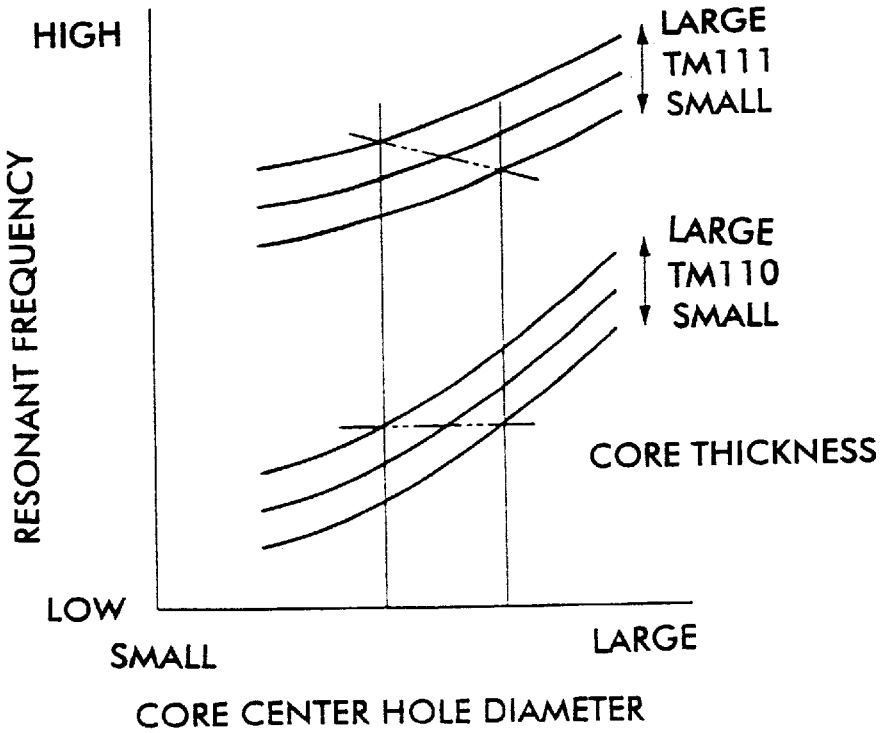

FIG. 18A is a perspective view of the structure of a multiple-mode dielectric resonator which represents a twelfth embodiment of the present invention, and FIG. 18B is a graph showing resonant frequency change characteristics of the multiple-mode dielectric resonator. As shown in FIG. 18A, a combined dielectric block 2 formed of two dielectric elements 2*a* and 2*b* combined into a crossed shape is formed integrally with a cavity body 1 while being positioned inside the same, and a core center hole 6 is formed in a central portion of the combined dielectric block 2.

FIG. 18B shows changes in the resonant frequencies of a TM110 mode and a TM111 mode with respect to changes in the inside diameter of the core center hole 6 with the thickness of the combined dielectric block (the size in the directions of height and width as indicated by the arrows in FIG. 18(A), hereinafter referred to as "core thickness") used as a parameter. If the inside diameter of the core center hole 6 is increased, the resonant frequency of each mode becomes higher. However, since at the center of the combined dielectric block 2 the electric field distribution of the TM110 mode has a degree of concentration higher than that of the electric field distribution of the TM111 mode, the rate of change in the resonant frequency of the TM110 mode with respect to changes in the inside diameter of the core center hole 6 is higher than that of the TM111 mode. On the other hand, the resonant frequencies of the TM110 mode and the TM111 mode change substantially at the same rate with respect to changes in the core thickness. Therefore, when both the inside diameter of the core center hole 6 and the core thickness are changed so that the resonant frequency of the TM110 mode is constant as indicated by the double-dot-dash line, the resonant frequency of the TM111 mode is not constant and changes as shown in the graph. By using this relationship, the resonant frequency of the TM110 mode and the resonant frequency of the TM111 mode can be determined relative to each other.

Figure 19A:
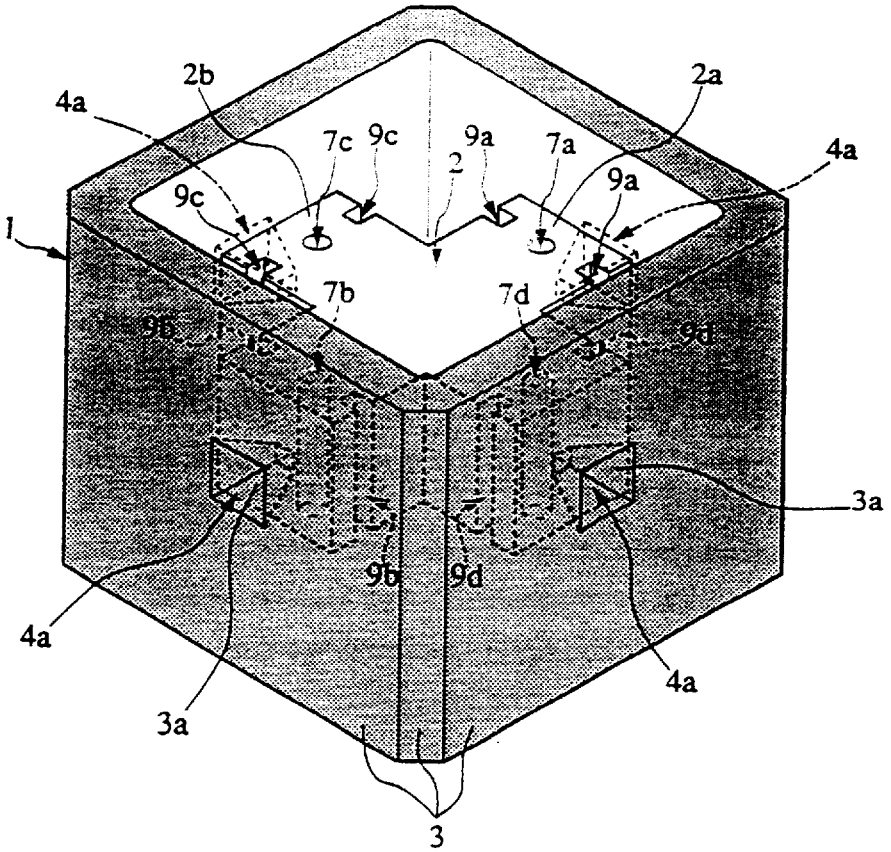
FIGS. 19A and 19B are an exploded perspective view and a graph, respectively, of a multiple-mode dielectric resonator which represents a thirteenth embodiment of the present invention, the graph showing characteristics of changes in resonant frequency.
Figure 19B:
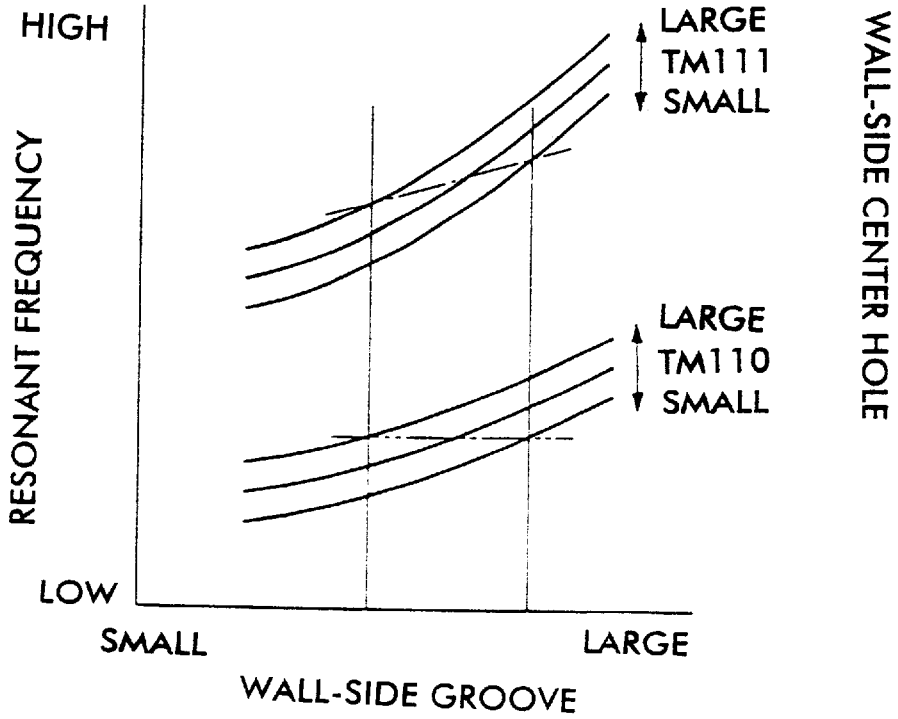

FIG. 19A is a perspective view of the structure of a multiple-mode dielectric resonator which represents a thirteenth embodiment of the present invention, and FIG. 19B is a graph showing resonant frequency change characteristics of the multiple-mode dielectric resonator. As shown in FIG. 19A, a combined dielectric block 2 formed of two dielectric elements 2*a* and 2*b* combined into a crossed shape is formed integrally with a cavity body 1 while being positioned inside the same. At a center of each of end surfaces of the dielectric elements 2*a* and 2*b* connected to the cavity body 1, a hole 4*a* is formed in the outer surface of the cavity body 1 so as to extend to an inner portion of the dielectric element 2*a* or 2*b*, and a conductor 3*a* is formed on inner surfaces of each hole 4*a*. In the combined dielectric block 2, wall-side center holes 7*a*, 7*b*, 7*c*, and 7*d* are formed and grooves 9*a*, 9*b*, 9*c*, and 9*d* are also formed in such positions that the wall-side center holes 7*a* to 7*d* are interposed between the grooves 9*a* to 9*d*. These grooves will hereinafter be referred to as "wall-side lateral grooves".

FIG. 19B shows changes in the resonant frequencies of a TM110 mode and a TM111 mode with respect to changes in the size of the wall-side lateral grooves 9*a* to 9*d* with the inside diameter of the wall-side center holes 7*a* to 7*d* used as a parameter. If the size of the wall-side lateral grooves 9*a* to 9*d* is increased, the resonant frequency of each mode becomes higher. However, since in the vicinity of the wall-side lateral grooves 9*a* to 9*d* the electric field distribution of the TM111 mode has a degree of concentration higher than that of the electric field distribution of the TM110 mode, the rate of change in the resonant frequency of the TM111 mode with respect to changes in the size of the wall-side lateral grooves 9*a* to 9*d* is higher than that of the TM110 mode. On the other hand, the resonant frequencies of the TM110 mode and the TM111 mode change substantially at the same rate with respect to changes in the inside diameter of the wall-side center holes 7*a* to 7*d*. Therefore, when both the size of the wall-side lateral grooves 9*a* to 9*d* and the inside diameter of the wall-side center holes 7*a* to 7*d* are changed so that the resonant frequency of the TM110 mode is constant as indicated by the double-dot-dash line, the resonant frequency of the TM111 mode is not constant and changes as shown in the graph. By using this relationship, the resonant frequency of the TM110 mode and the resonant frequency of the TM111 mode can be determined relative to each other. For example, if a band-pass filter is formed by using two TM110 modes (with a TM111 mode treated as a spurious mode), the resonant frequency of a TM111 mode may be determined relative to the resonant frequencies of the TM110 modes so as to obtain a desired attenuation characteristic. To couple one of the TM110 modes and the TM111 mode to each other, the size of the wall-side lateral grooves 9*a* to 9*d* is reduced to bring the resonant frequency of the TM111 mode closer to the resonant frequency of the TM110 mode so that the frequencies of the two modes are approximately equal to each other. To this effect, the size of the wall-side lateral grooves may be reduced in such a manner that a dielectric material is applied to inner portions of the wall-side lateral grooves previously formed.

Figure 20A:
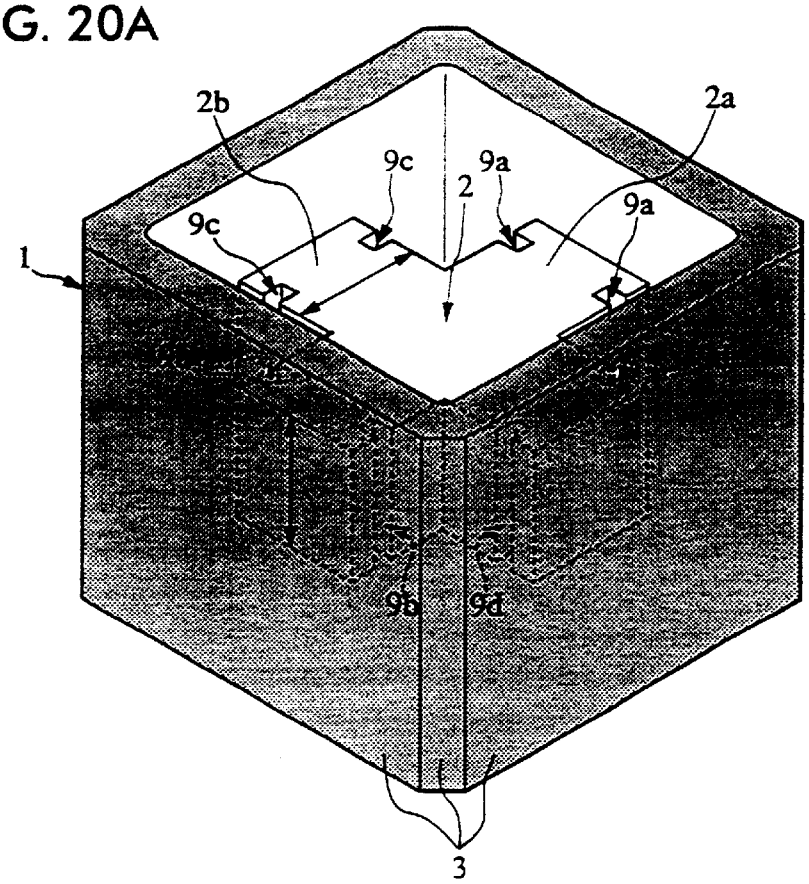
FIGS. 20A and 20B are an exploded perspective view and a graph, respectively, of a multiple-mode dielectric resonator which represents a fourteenth embodiment of the present invention, the graph showing characteristics of changes in resonant frequency.
Figure 20B:
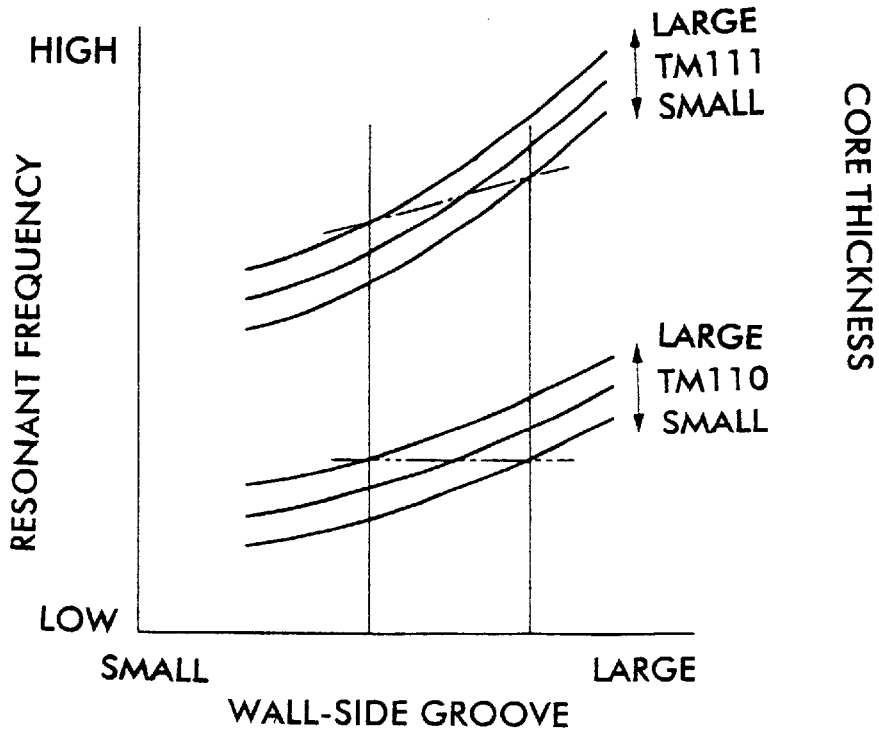

FIG. 20A is a perspective view of the structure of a multiple-mode dielectric resonator which represents a fourteenth embodiment of the present invention, and FIG. 20B is a graph showing resonant frequency change characteristics of the multiple-mode dielectric resonator. As shown in FIG. 20A, a combined dielectric block 2 formed of two dielectric elements 2*a* and 2*b* combined into a crossed shape is formed integrally with a cavity body 1 while being positioned inside the same, and wall-side lateral grooves 9*a* to 9*d* are formed in the combined dielectric block 2.

FIG. 20B shows changes in the resonant frequencies of a TM110 mode and a TM111 mode with respect to changes in the size of the wall-side lateral grooves 9*a* to 9*d* with the core thickness of the combined dielectric block used as a parameter. If the size of the wall-side lateral grooves 9*a* to 9*d* is increased, the resonant frequency of each mode becomes higher as in the above-described case. However, since the electric field distribution of the TM111 mode has a degree of concentration higher than that of the electric field distribution of the TM110 mode in the vicinity of the wall-side lateral grooves 9*a* to 9*d* of the combined dielectric block 2, the rate of change in the resonant frequency of the TM111 mode with respect to changes in the size of the wall-side lateral grooves is higher than that of the TM110 mode. On the other hand, the resonant frequencies of the TM110 mode and the TM111 mode change substantially at the same rate with respect to changes in the core thickness.

Therefore, when both the size of the wall-side lateral grooves and the core thickness are changed so that the resonant frequency of the TM110 mode is constant as indicated by the double-dot-dash line, the resonant frequency of the TM110 mode is not constant and changes as shown in the graph. By using this relationship, the resonant frequency of the TM110 mode and the resonant frequency of the TM111 mode can be determined relative to each other.

Figure 21A:
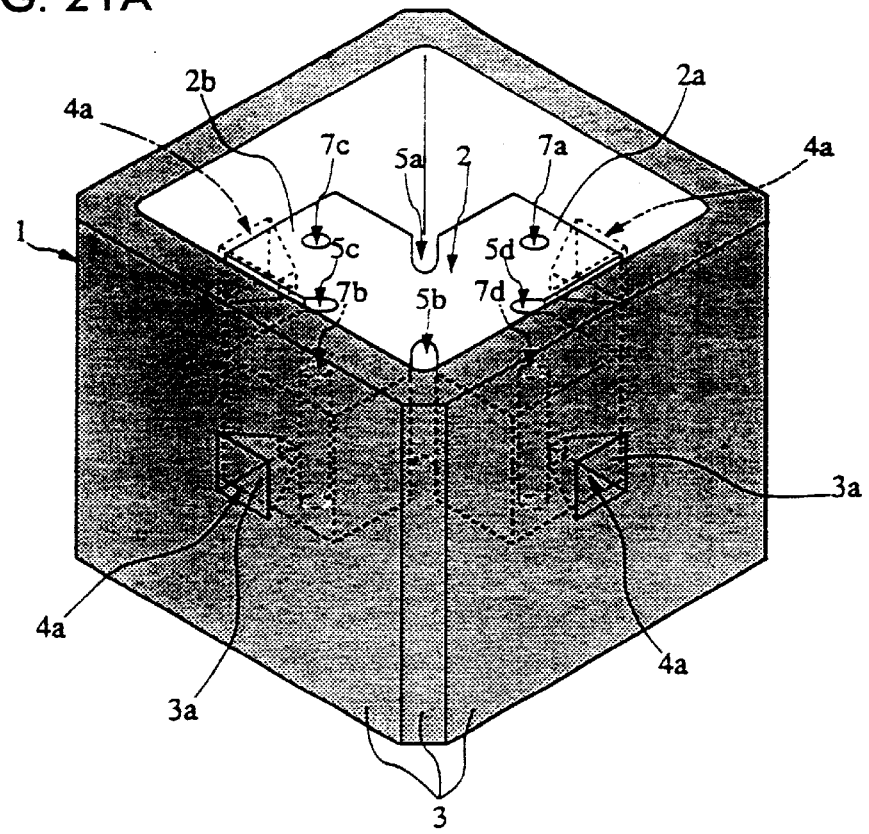
FIGS. 21A and 21B are an exploded perspective view and a graph, respectively, of a multiple-mode dielectric resonator which represents a fifteenth embodiment of the present invention, the graph showing characteristics of changes in resonant frequency.
Figure 21B:
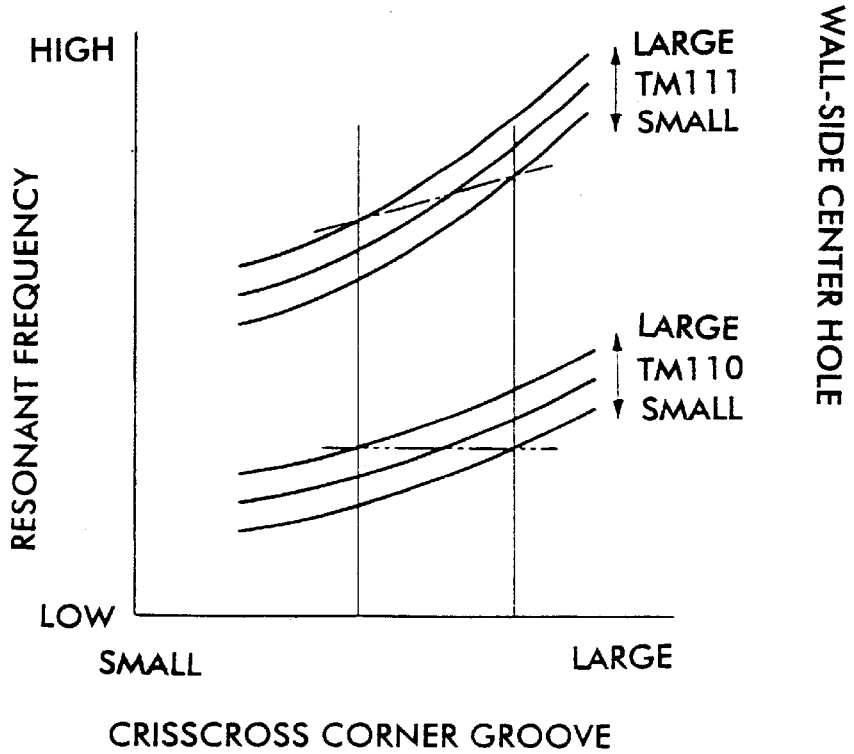

FIG. 21A is a perspective view of the structure of a multiple-mode dielectric resonator which represents a fifteenth embodiment of the present invention, and FIG. 21B is a graph showing resonant frequency change characteristics of the multiple-mode dielectric resonator. As shown in FIG. 21A, a combined dielectric block 2 formed of two dielectric elements 2*a* and 2*b* combined into a crossed shape is formed integrally with a cavity body 1 while being positioned inside the same. At a center of each of end surfaces of the dielectric elements 2*a* and 2*b* connected to the cavity body 1, a hole 4*a* is formed in the outer surface of the cavity body 1 so as to extend to an inner portion of the dielectric element 2*a* or 2*b*, and a conductor 3*a* is formed on inner surfaces of each hole 4*a*. In the combined dielectric block wall-side center holes 7*a*, 7*b*, 7*c*, and 7*d*, and crisscross corner grooves 5*a*, 5*b*, 5*c*, and 5*d* are formed.

FIG. 21B shows changes in the resonant frequencies of a TM110 mode and a TM111 mode with respect to changes in the size of the crisscross corner grooves 5*a* to 5*d* with the inside diameter of the wall-side center holes 7*a* to 7*d* used as a parameter. If the size of the crisscross corner grooves 5*a* to 5*d* is increased, the resonant frequency of each mode becomes higher. However, since at the crossing corners of the combined dielectric block the electric field distribution of the TM111 mode has a degree of concentration higher than that of the electric field distribution of the TM110 mode, the rate of change in the resonant frequency of the TM111 mode with respect to changes in the size of the crisscross corner grooves 5*a* to 5*d* is higher than that of the TM110 mode. On the other hand, the resonant frequencies of the TM110 mode and the TM111 mode change substantially at the same rate with respect to changes in the inside diameter of the wall-side center holes 7*a* to 7*d*. Therefore, when both the size of the crisscross corner grooves 5*a* to 5*d* and the inside diameter of the wall-side center holes 7*a* to 7*c* are changed so that the resonant frequency of the TM110 mode is constant as indicated by the double-dot-dash line, the resonant frequency of the TM111 mode is not constant and changes as shown in the graph. By using this relationship, the resonant frequency of the TM110 mode and the resonant frequency of the TM110 mode can be determined relative to each other.

Figure 22A:
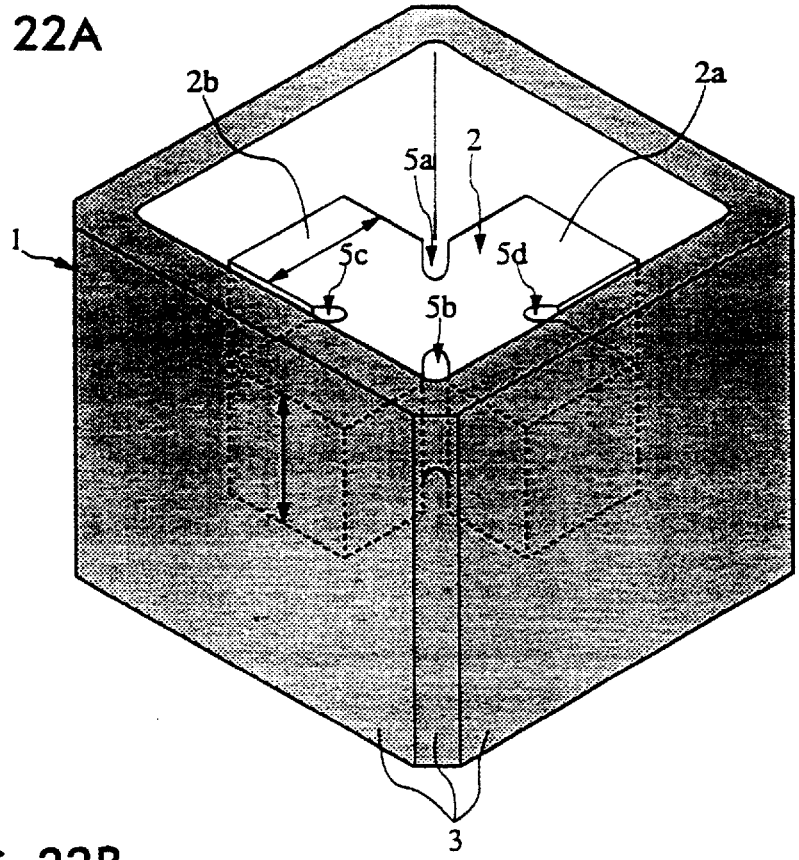
FIGS. 22A and 22B are an exploded perspective view and a graph, respectively, of a multiple-mode dielectric resonator which represents a sixteenth embodiment of the present invention, the graph showing characteristics of changes in resonant frequency.
Figure 22B:
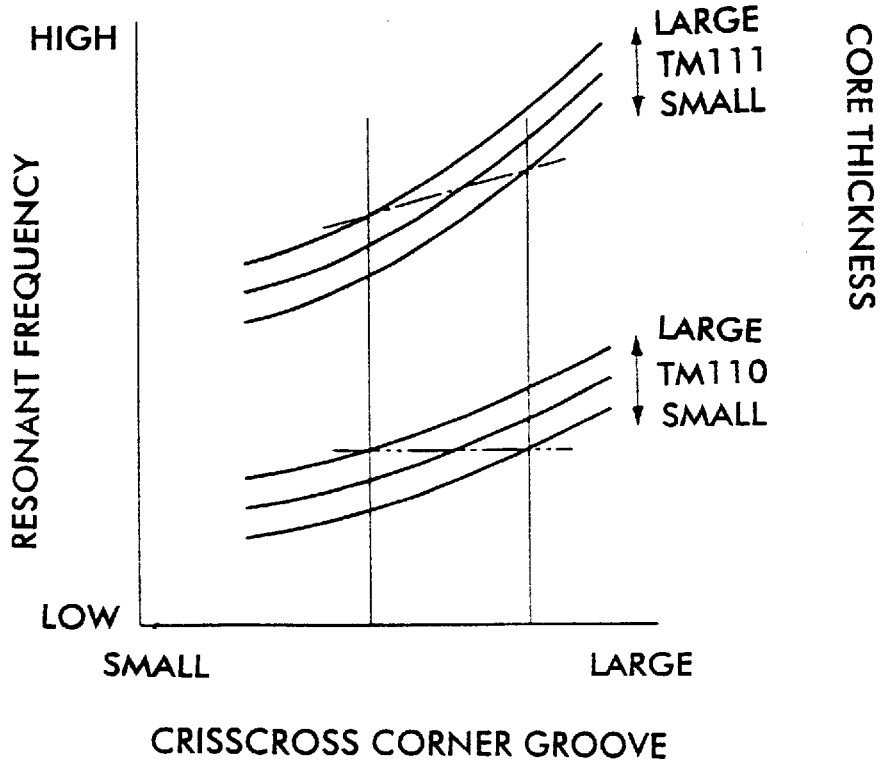
Figure 23:
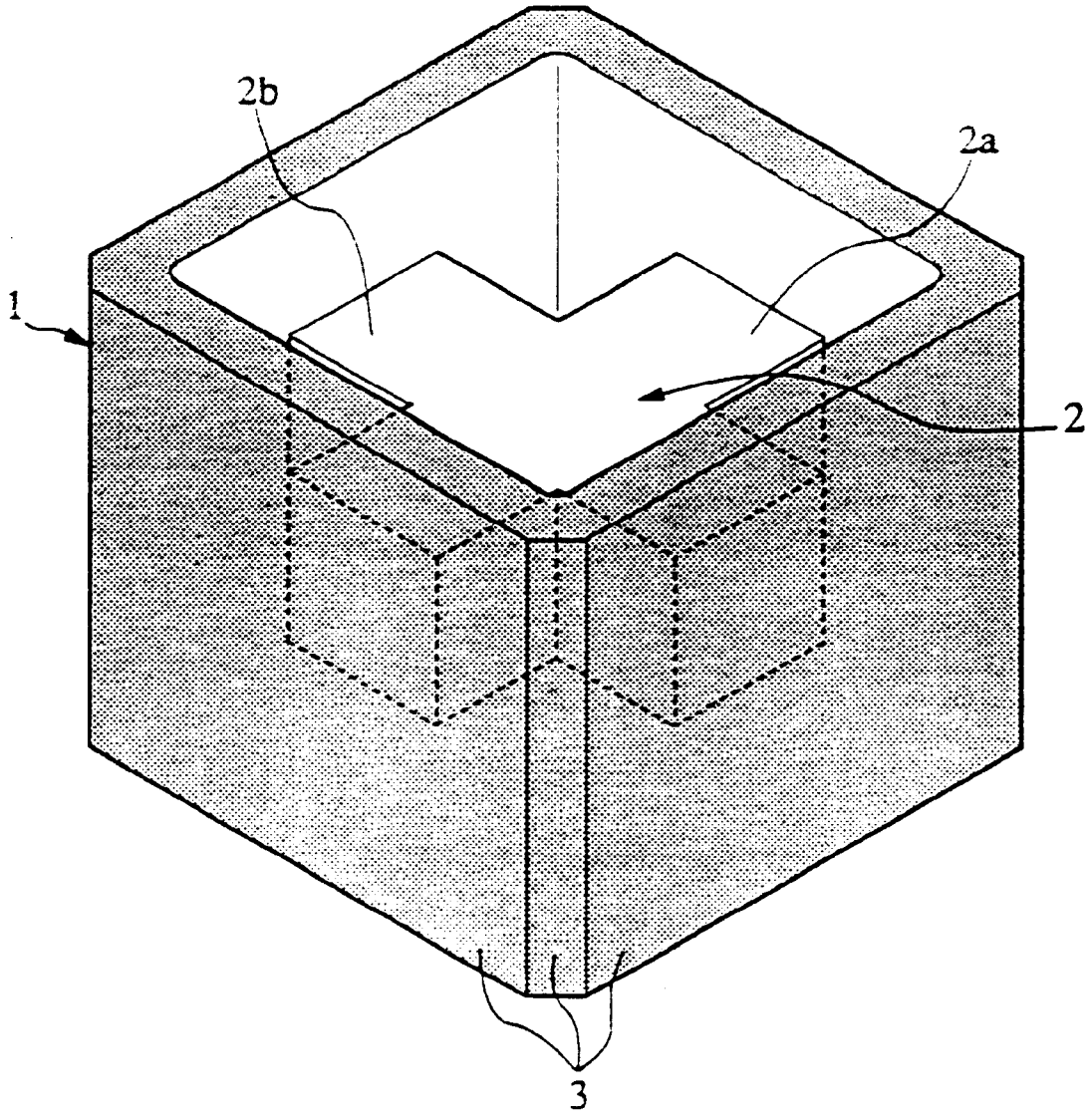
FIG. 23 PRIOR ART
FIG. 23 is a perspective view of a conventional TM dual mode dielectric resonator.

FIG. 22A is a perspective view of the structure of a multiple-mode dielectric resonator which represents a sixteenth embodiment of the present invention, and FIG. 22B is a graph showing resonant frequency change characteristics of the multiple-mode dielectric resonator. As shown in FIG. 22A, a combined dielectric block 2 formed of two dielectric elements 2*a* and 2*b* combined into a crossed shape is formed integrally with a cavity body 1 while being positioned inside the same. Crisscross corner grooves 5*a*, 5*b*, 5*c*, and 5*d* are formed in the combined dielectric block 2.

FIG. 22B shows changes in the resonant frequencies of a TM110 mode and a TM111 mode with respect to changes in the size of the crisscross corner grooves 5*a* to 5*d* with the core thickness used as a parameter. If the size of the crisscross corner grooves 5*a* to 5*d* is increased, the resonant frequency of each mode becomes higher as in the above-described case. However, since at the crossing corners of the combined dielectric block the electric field distribution of the TM111 mode has a degree of concentration higher than that of the electric field distribution of the TM110 mode, the rate of change in the resonant frequency of the TM111 mode with respect to changes in the size of the crisscross corner grooves 5*a* to 5*d* is higher than that of the TM110 mode. On the other hand, the resonant frequencies of the TM110 mode and the TM111 mode change substantially at the same rate with respect to changes in the core thickness. Therefore, when both the core thickness and the size of the crisscross corner grooves are changed so that the resonant frequency of the TM110 mode is constant as indicated by the double-dot-dash line, the resonant frequency of the TM111 mode is not constant and changes as shown in the graph. By using this relationship, the resonant frequency of the TM110 mode and the resonant frequency of the TM111 mode can be determined relative to each other.

According to the first aspect of the present invention, one of three resonance modes, i.e., two pseudo TM110 modes and TM111 mode, caused along a plane defined by two of the plurality of dielectric elements, is set as a resonant frequency setting object, and the resonant frequency of this resonance mode can be determined independently of the resonant frequencies of the other two resonance modes.

According to the second aspect of the present invention, one of three resonance modes, i.e., two pseudo TM110 modes and TM111 mode, caused along a plane defined by two of the plurality of dielectric elements, is set as a resonant frequency setting object, and both the resonant frequencies of the two resonance modes other than the resonant frequency setting object can be changed to determine the resonant frequency of the one resonance mode set as the resonant frequency setting object to be determined relative to the resonant frequencies of the two resonance modes.

According to the third aspect of the present invention, the first resonance mode corresponding to pseudo TM110 mode and the second resonance mode corresponding to pseudo TM111 mode are coupled to each other and the degree of coupling therebetween can be determined by the amount of cut in the predetermined portion or the amount of the dielectric material applied to the predetermined portion.

According to the fourth aspect of the present invention, the first resonance mode and the third resonance mode each corresponding to pseudo TM110 mode are coupled to each other and the degree of this coupling is determined by the amount of cut in the predetermined portion or the amount of the dielectric material applied to the predetermined portion.

According to the fifth aspect of the present invention, if, for example, a dielectric filter using two TM110 modes is formed, the resonant frequency of the TM111 mode used as a spurious mode can be determined relative to the resonant frequencies of the two TM111 modes without changing the resonant frequencies of the two TM110 modes.

According to the sixth and seventh aspects of the present invention, the pseudo TM110 modes and the pseudo TM111 mode are coupled to each other, thereby making it possible to form a dielectric resonator device having a plurality of dielectric resonator stages.

According to the eighth aspect of the present invention, a dielectric filter having a plurality of resonator stages and small in size and weight can be formed.

According to the ninth aspect of the present invention, an input and output device sharing an input or output section for a duplexer, a multiplexer or the like and small in size and weight can be formed.

What is claimed is:

1. A dielectric resonator including a dielectric resonator element having two parts arranged perpendicular to each other and disposed in a cavity so as to form a TM dual-mode dielectric resonator element, the TM dual-mode dielectric resonator element having a TM 110-mode resonant frequency and a TM111-mode resonant frequency, said dielectric resonator having a cut-portion in said dielectric resonator element so that the TM110-mode resonant frequency of the dielectric resonator element is substantially equal to the TM111-mode resonant frequency.

2. A multiple-mode dielectric resonator comprising:

a region surrounded with a conductor; and a combined dielectric block formed of a plurality of dielectric elements combined into a crossed shape, said combined dielectric block being placed in said region, wherein one of first to third resonance modes having no concentration or a lower degree of concentration of an electric field distribution in a least one region in comparison with the other two of the first to third resonance modes is set as a resonant frequency setting object, the first and third resonance modes comprising two pseudo TM110 modes along a plane defined by two of said plurality of dielectric elements, the two pseudo TM110 modes having different lines of symmetry of electric field distributions, the second resonance mode comprising a pseudo TM111 mode along the same plane, and wherein the resonant frequency of the resonance mode set as the resonant frequency setting object is determined relative to the resonant frequencies of the other two resonance modes by a dielectric-cut portion formed in a portion of said combined dielectric block corresponding to the region with no concentration or a lower degree of concentration of the electric field distribution, and/or by a dielectric material applied to a portion of said combined dielectric block corresponding to the region with no concentration or a lower degree of concentration of the electric field distribution.

* * * * *